US012168582B2

(12) United States Patent
Ao et al.

(10) Patent No.: US 12,168,582 B2
(45) Date of Patent: Dec. 17, 2024

(54) DRIVE TRANSMISSION DEVICE, FEEDING DEVICE, AND PRINTING APPARATUS

(71) Applicant: Seiko Epson Corporation, Tokyo (JP)

(72) Inventors: Junko Ao, Shiojiri (JP); Katsuyuki Kondo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 325 days.

(21) Appl. No.: 17/652,151

(22) Filed: Feb. 23, 2022

(65) Prior Publication Data

US 2022/0275853 A1 Sep. 1, 2022

(30) Foreign Application Priority Data

Feb. 26, 2021 (JP) ..... 2021-029429
Sep. 16, 2021 (JP) ..... 2021-150952

(51) Int. Cl.
*B65H 1/14* (2006.01)
*B65H 1/04* (2006.01)

(52) U.S. Cl.
CPC ..... *B65H 1/14* (2013.01); *B65H 1/04* (2013.01); *B65H 2403/10* (2013.01); *B65H 2403/481* (2013.01); *B65H 2403/51* (2013.01)

(58) Field of Classification Search
CPC ..... B65H 2403/51; B65H 2403/481
See application file for complete search history.

(56) References Cited

FOREIGN PATENT DOCUMENTS

JP 4045433 B2 * 2/2008
JP 5679610 B2 * 3/2015
JP 2018-090420 6/2018

OTHER PUBLICATIONS

Translation of JP-4045433-B2 (Year: 2024).*

* cited by examiner

*Primary Examiner* — Howard J Sanders
(74) *Attorney, Agent, or Firm* — WORKMAN NYDEGGER

(57) ABSTRACT

A drive transmission unit includes a cam member, a motor, a cam follower, and an extension spring. The cam member rotates about a rotation shaft. The cam member includes a first cam defining a maximum distance between the cam follower and the rotation shaft and a second cam having an outer peripheral surface positioned closer to the rotation shaft than the outer peripheral surface of the first cam. The motor rotates the rotation shaft. The cam follower is to be in contact with the cam member and moves in the +B direction and the −B direction by the rotation of the cam member. The extension spring presses the cam follower against the cam member. When the cam follower moves in the −B direction by the rotation of the cam member, this operation includes contact between the outer peripheral surface of the second cam and the cam follower.

11 Claims, 26 Drawing Sheets

DRIVE TRANSMISSION DEVICE, FEEDING DEVICE, AND PRINTING APPARATUS

The present application is based on, and claims priority from JP Application Serial Number 2021-029429, filed Feb. 26, 2021 and JP Application Serial Number 2021-150952, filed Sep. 16, 2021, the disclosures of which are hereby incorporated by reference herein in their entirety.

BACKGROUND

1. Technical Field

The present disclosure relates to a drive transmission device, a feeding device, and a printing apparatus.

2. Related Art

The sheet transporting apparatus in JP-A-2018-90420 includes a lift plate configured to cause a downstream portion of a sheet to be in contact with a transporting roller and a lift device configured to lift up and down the lift plate. The lift device includes an eccentric cam, a pressing bar, and a motor. When the motor rotates the eccentric cam and the pressing bar is operated, the lift device lifts up and down the lift plate.

When the lift plate is lifted up and down by converting the rotary motion of the cam into the reciprocating motion of the lift plate, as in the sheet transporting apparatus in JP-A-2018-90420, the distance between the rotation center position of the cam and the lift plate changes upon rotation of the cam. In this operation, along with the rotation of the cam, the point of contact between the cam and the lift plate shifts along the lift plate, which may increase the torque acting on the cam and the drive source.

SUMMARY

A drive transmission device of the present disclosure includes: a cam portion configured to rotate about a rotation shaft; a drive source configured to drive the rotation shaft to rotate the cam portion; a cam follower configured to be in contact with the cam portion and move, by rotation of the cam portion, in a first direction to be close to the rotation shaft and in a second direction to be away from the rotation shaft; and a pressing portion configured to press the cam follower against the cam portion. The cam portion includes a first cam defining a maximum distance between the cam follower and the rotation shaft and a second cam having an inner edge portion positioned closer to the rotation shaft than an outer edge portion of the first cam. When the cam follower moves in the second direction by the rotation of the cam portion, this operation includes contact between the inner edge portion of the second cam and the cam follower.

DESCRIPTION OF EXEMPLARY EMBODIMENTS

Figure 1:
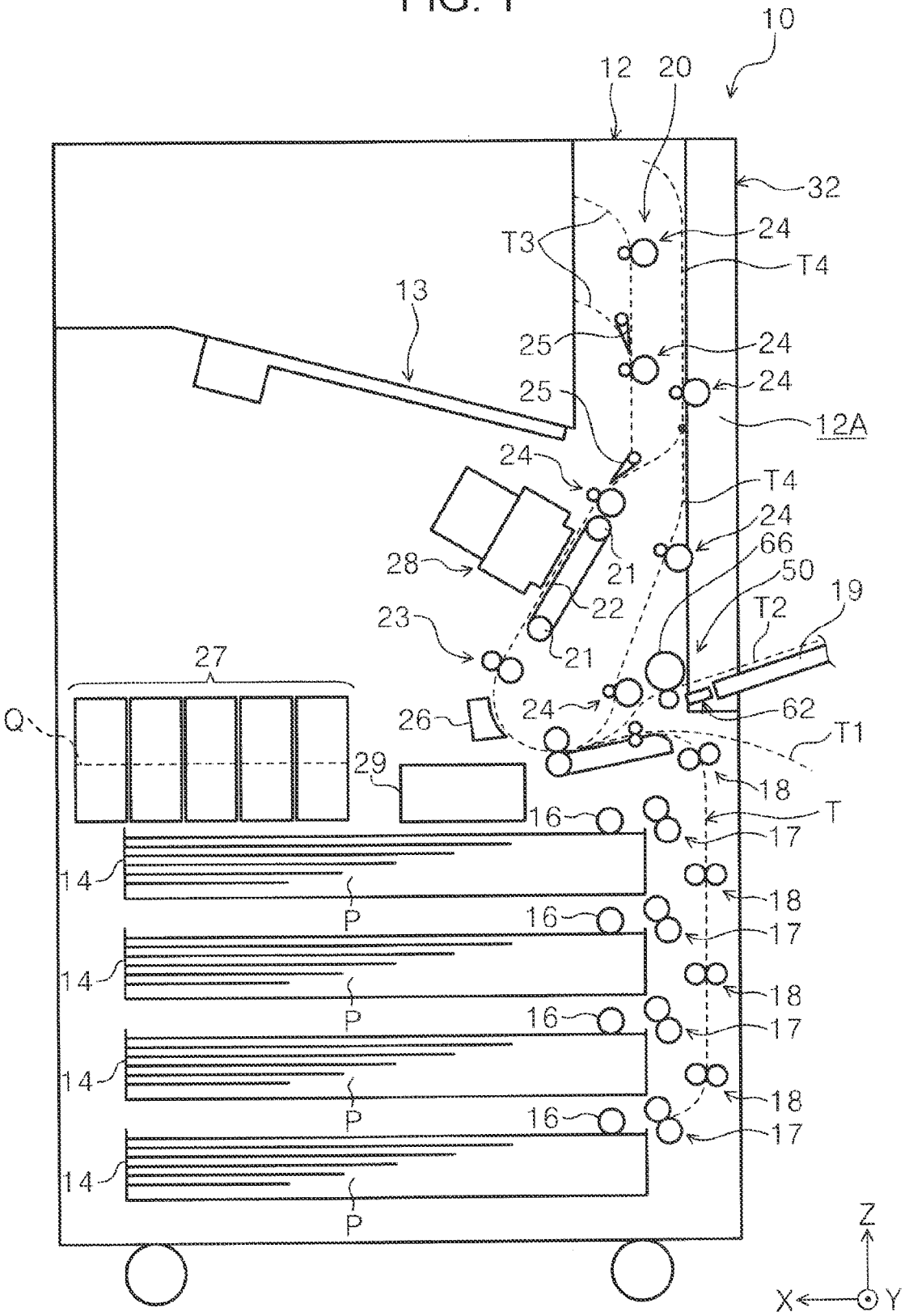
FIG. 1 is an overall configuration diagram of a printer according to an embodiment.

Hereinafter, the present disclosure will be schematically described.

A drive transmission device of a first aspect includes: a cam portion configured to rotate about a rotation shaft; a drive source configured to drive the rotation shaft to rotate the cam portion; a cam follower configured to be in contact with the cam portion and move, by rotation of the cam portion, in a first direction to be close to the rotation shaft and in a second direction to be away from the rotation shaft; and a pressing portion configured to press the cam follower against the cam portion. The cam portion includes a first cam defining a maximum distance between the cam follower and the rotation shaft and a second cam having an inner edge portion positioned closer to the rotation shaft than an outer edge portion of the first cam. When the cam follower moves in the second direction by the rotation of the cam portion, this operation includes contact between the inner edge portion of the second cam and the cam follower.

In this aspect, when the drive source rotates the cam portion, the first cam moves the cam follower in the second direction, and the cam follower moves to the position farthest from the rotation shaft. When the cam follower moves in the second direction by the rotation of the cam portion, this operation includes contact between the inner edge portion of the second cam and the cam follower. With this configuration, the contact counterpart of the cam follower can be switched from the first cam to the second cam.

Here, the pressing force caused by the pressing portion and acting on the contact position between the outer edge portion and the cam follower and the pressing force caused by the pressing portion and acting on the contact position between the inner edge portion and the cam follower are substantially equal. Since the inner edge portion is positioned closer to the rotation shaft than the outer edge portion, the distance from the center of the rotation shaft to the contact position between the inner edge portion and the cam follower is shorter than the distance from the center of the rotation shaft to the contact position between the outer edge portion and the cam follower.

In other words, the torque acting on the cam portion and the rotation shaft is smaller when the inner edge portion is in contact with the cam follower than when the outer edge portion is in contact with the cam follower. Thus, when the rotation shaft rotates, and the cam follower is moved in the second direction, the torque acting on the cam portion and the drive source can be small.

The drive transmission device of a second aspect according to the first aspect, further includes: a drive gear train configured to transmit a driving force from the drive source to the rotation shaft; a planetary gear configured to engage with part of the drive gear train; and a holding portion configured to hold the planetary gear such that the planetary gear is swingable between a first position at which the planetary gear engages with the part of the drive gear train and a second position at which the planetary gear does not engage with the part of the drive gear train. Torque acting on the rotation shaft when the inner edge portion is in contact with the cam follower acts in a direction to move the planetary gear from the first position to the second position.

In this aspect, since the torque acting on the rotation shaft and the drive gear train can be small when the inner edge portion is in contact with the cam follower, the holding portion is prevented from being shaken when the torque acts in the direction to move the planetary gear from the first position to the second position, and this prevents tooth skipping between the planetary gear and the drive gear train.

In the drive transmission device of a third aspect according to the first or second aspect, the cam follower has a first contact portion configured to be in contact with the outer edge portion and a second contact portion configured to be in contact with the inner edge portion, and when the rotation shaft is rotated in a state in which the outer edge portion is in contact with the first contact portion, contact between the inner edge portion and the second contact portion starts before the outer edge portion is apart from the first contact portion.

In this aspect, when the state transitions from the one in which the outer edge portion is in contact with the first contact portion to the one in which the inner edge portion is in contact with the second contact portion, there is a moment when the outer edge portion is in contact with the first contact portion, and also the inner edge portion is in contact with the second contact portion. Thus, immediately before the inner edge portion starts to be in contact with the second contact portion, there is no moment when the cam follower is in contact with neither the outer edge portion nor the inner edge portion. This configuration reduces fluctuation of the torque acting on the drive source via the rotation shaft at the time when the contact counterpart of the cam follower is switched from the first cam to the second cam.

In the drive transmission device of a fourth aspect according to any one of the first to third aspects, in one rotation of the rotation shaft, before the inner edge portion is apart from the cam follower, contact between the outer edge portion and the cam follower starts.

In this aspect, during one rotation of the rotation shaft, the contact counterpart of the cam follower changes from the outer edge portion via the inner edge portion to the outer edge portion. In this configuration, as compared with the configuration in which the contact counterpart of the cam follower changes only from the outer edge portion to the inner edge portion during one rotation of the rotation shaft, the time during which the cam follower is in contact with the inner edge portion is short. Thus, it is possible to reduce the sliding wear of the inner edge portion.

In the drive transmission device of a fifth aspect according to any one of the first to fourth aspects, the first cam and the second cam are integrally formed.

In this aspect, since the dimensional error of the second cam relative to the first cam that occurs in assembling can be eliminated, the positional accuracy of the second cam relative to the first cam can be high, compared to the configuration in which the first cam and the second cam are separate portions.

In the drive transmission device of a sixth aspect according to any one of the first to fifth aspects, a second friction coefficient, which is a coefficient of friction between the inner edge portion and the cam follower, is higher than a first friction coefficient, which is a coefficient of friction between the outer edge portion and the cam follower.

In this aspect, when the state transitions from the one in which the outer edge portion is in contact with the cam follower to the one in which the inner edge portion is in contact with the cam follower, the second friction coefficient higher than the first friction coefficient generates the counter torque acting on the inner edge portion which is in contact with the cam follower. This configuration reduces a rapid increase in the rotation speed of the second cam when the inner edge portion is in contact with the cam follower.

In the drive transmission device of a seventh aspect according to any one of the first to sixth aspects, when the cam follower moves in the first direction, this operation includes contact between the inner edge portion and the cam follower.

In this aspect, when the cam follower is moved in the first direction by the rotation of the cam portion, this operation includes contact between the inner edge portion and the cam follower. With this configuration, the contact counterpart of the cam follower can be switched from the first cam to the second cam.

Here, as mentioned above, the pressing force caused by the pressing portion and acting on the contact position between the outer edge portion and the cam follower and the pressing force caused by the pressing portion and acting on the contact position between the inner edge portion and the cam follower are substantially equal. Since the inner edge portion is positioned closer to the rotation shaft than the outer edge portion, the distance from the center of the rotation shaft to the contact position between the inner edge portion and the cam follower is shorter than the distance from the center of the rotation shaft to the contact position between the outer edge portion and the cam follower.

In other words, the torque acting on the cam portion is smaller when the inner edge portion is in contact with the cam follower than when the outer edge portion is in contact with the cam follower. Thus, when the rotation shaft rotates, and the cam follower is moved in the first direction, the torque acting on the cam portion can be small, and the rotation of the cam portion on its axis can be reduced.

In the drive transmission device of an eighth aspect according to any one of the first to seventh aspects, the cam portion is provided with a brake member configured to impede the rotation of the cam portion, the cam portion is configured to move, by rotating about the rotation shaft, to a first position at which at least one of the first cam and the second cam is in contact with the cam follower and to a second position at which neither the first cam nor the second cam is in contact with the cam follower, and the brake member impedes the rotation of the cam portion at the second position.

In a configuration in which the cam portion can move to a position at which the cam portion is in contact with the cam follower and a position at which it is not, it is difficult in some cases to stop the cam portion at the optimum position, when the cam portion is at the position at which the cam portion is not in contact with the cam follower. However, in this aspect, the cam portion includes the brake member, and the brake member impedes the rotation of the cam portion at the second position at which the cam portion is not in contact with the cam follower. Thus, even in the state in which the cam portion is not in contact with the cam follower, it is possible to stop the cam portion at the optimum position.

The drive transmission device of ninth aspect according to the eighth aspect, further includes: a contacted portion configured to be in contact with the brake member; and an urging portion configured to urge the brake member in a projecting direction in which the brake member projects from the first cam. The brake member is configured to move to a projecting position at which the brake member projects from the first cam by being urged by the urging portion and to a retreat position, to which the brake member moves from the projecting position in a direction opposite from the projecting direction, positioned in a direction opposite from the projecting position, and when the brake member is in contact with the contacted portion at the second position, the brake member moves from the projecting position to the retreat position against an urging force of the urging portion.

In this aspect, since the brake member can move to the projecting position and the retreat position, the brake member can be positioned inside the cam portion, and thus, the drive transmission device can be reduced in size.

A feeding device of a tenth aspect includes: the drive transmission device according to any one of the first to ninth aspects; a lift member configured to be lifted up and down, along with movement of the cam follower, from one of a feeding position at which a medium is ready to be fed and a retreat position that is away from the feeding position, to the other of the feeding position and the retreat position; and a feeding roller configured to rotate and feed a medium on the lift member when the lift member is at the feeding position.

This aspect provides operations and effects the same as or similar to those provided by any one of the first to seventh aspects.

A printing apparatus of an eleventh aspect includes: the feeding device according to the tenth aspect; and a printing unit configured to perform printing on a medium fed from the feeding device.

This aspect provides operations and effects the same as or similar to those provided by the eighth aspect.

Hereinafter, examples of a drive transmission device, a feeding device, and a printing apparatus according to the present disclosure will be specifically described as an embodiment.

FIG. 1 illustrates a printer 10 as an example of a printing apparatus.

The printer 10 is an ink jet apparatus that performs printing by ejecting ink Q, which is an example of liquid, onto a sheet P, which is an example of a medium. Note that the X-Y-Z coordinate system in each figure represents a Cartesian coordinate system.

The X direction is the apparatus width direction viewed from the operator of the printer 10, which is a horizontal direction. The direction to the left in the X direction is defined as the +X direction, and the direction to the right as the −X direction.

The Y direction is the width direction intersecting the transportation direction of sheets P and is the apparatus depth direction, which is a horizontal direction. The direction to the near side in the Y direction is defined as the +Y direction, and the direction to the far side as the −Y direction.

The Z direction is an example of the apparatus height direction and is the vertical direction. The upward direction in the Z direction is defined as the +Z direction, and the downward direction as the −Z direction. In the present embodiment, the term "upward" means any direction including an upward component in the Z direction. The term "downward" means any direction including a downward component in the Z direction.

In the printer 10, a sheet P is transported through transporting path T indicated by the dashed lines. The direction in which a sheet P is transported on the transporting path T is different between respective portions in the transporting path T.

The printer 10 includes an apparatus body 12, a transportation unit 20, a feeding unit 50, and a line head 28.

The apparatus body 12 includes a housing, which is an outer case, and a plurality of frames (not illustrated). The apparatus body 12 has a discharge portion 13 formed at a portion in the +Z direction from the center in the Z direction. The discharge portion 13 includes a space into which printed sheets P are discharged. The apparatus body 12 includes a plurality of sheet cassettes 14. The apparatus body 12 has an opening 12A open in the X direction at an end portion in the −X direction of the apparatus body 12.

Figure 2:
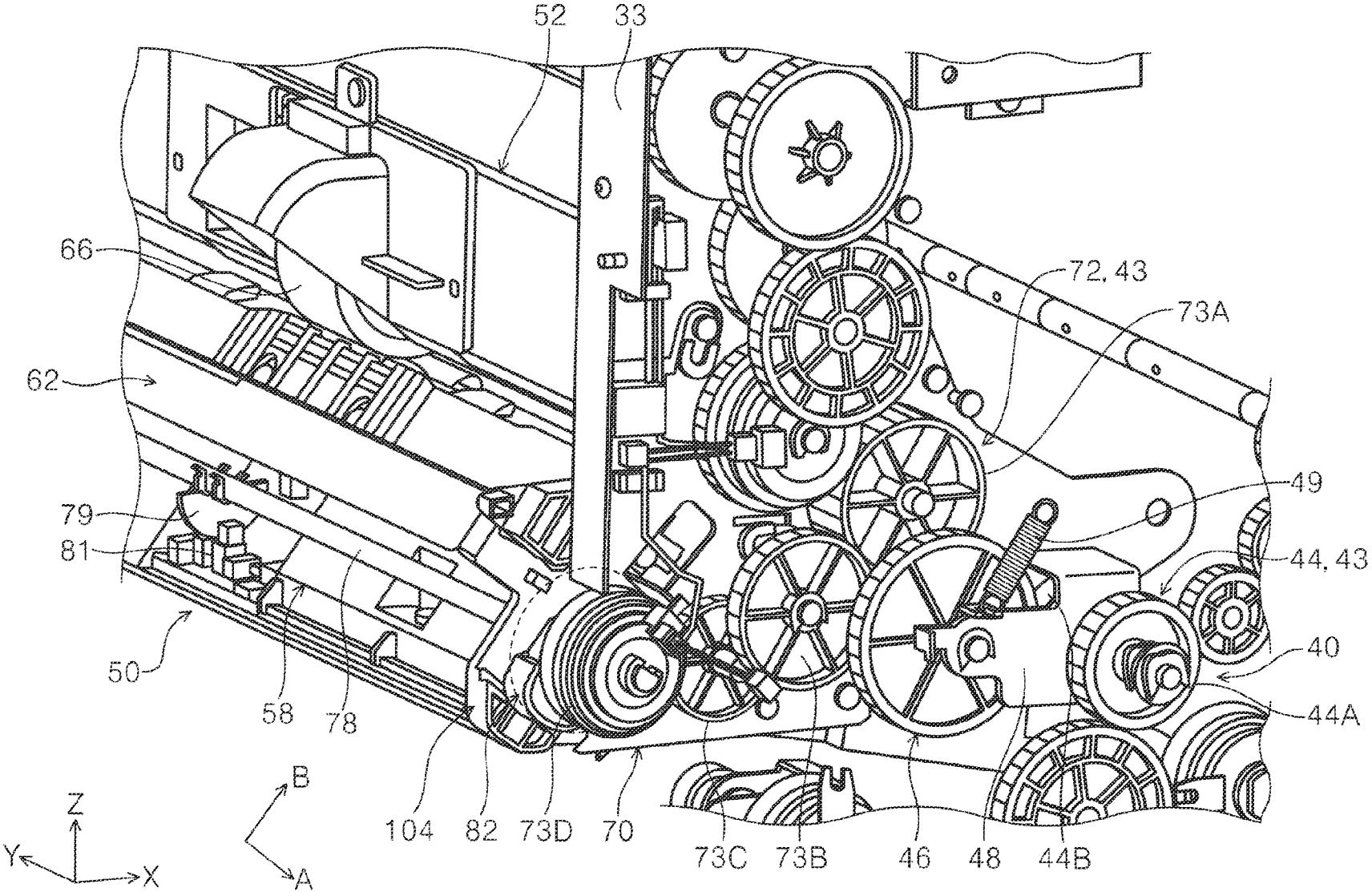
FIG. 2 is a perspective view of a drive transmission unit in a feeding unit according to the embodiment.

The apparatus body 12 has a door portion 32 that opens and closes the opening 12A, and a body drive unit 40 (FIG. 2).

The door portion 32 is formed in a plate shape having a certain thickness. At an end portion in the −X direction of the apparatus body 12, the door portion 32 is provided at an end portion in the −Y direction of the opening 12A with a hinge unit (not illustrated). With this configuration, the door portion 32 is rotatable around a axis (not illustrated) along the Z direction.

The door portion 32 can, by rotating, open or close the opening 12A to expose or hide an inversion path T4 which is part of the transporting path T. In other words, the door portion 32 can rotate between an open position to expose the inversion path T4 and a close position to hide the inversion path T4. The door portion 32 includes body frames 33 (FIG. 2) having an interval in between in the Y direction.

Figure 5:
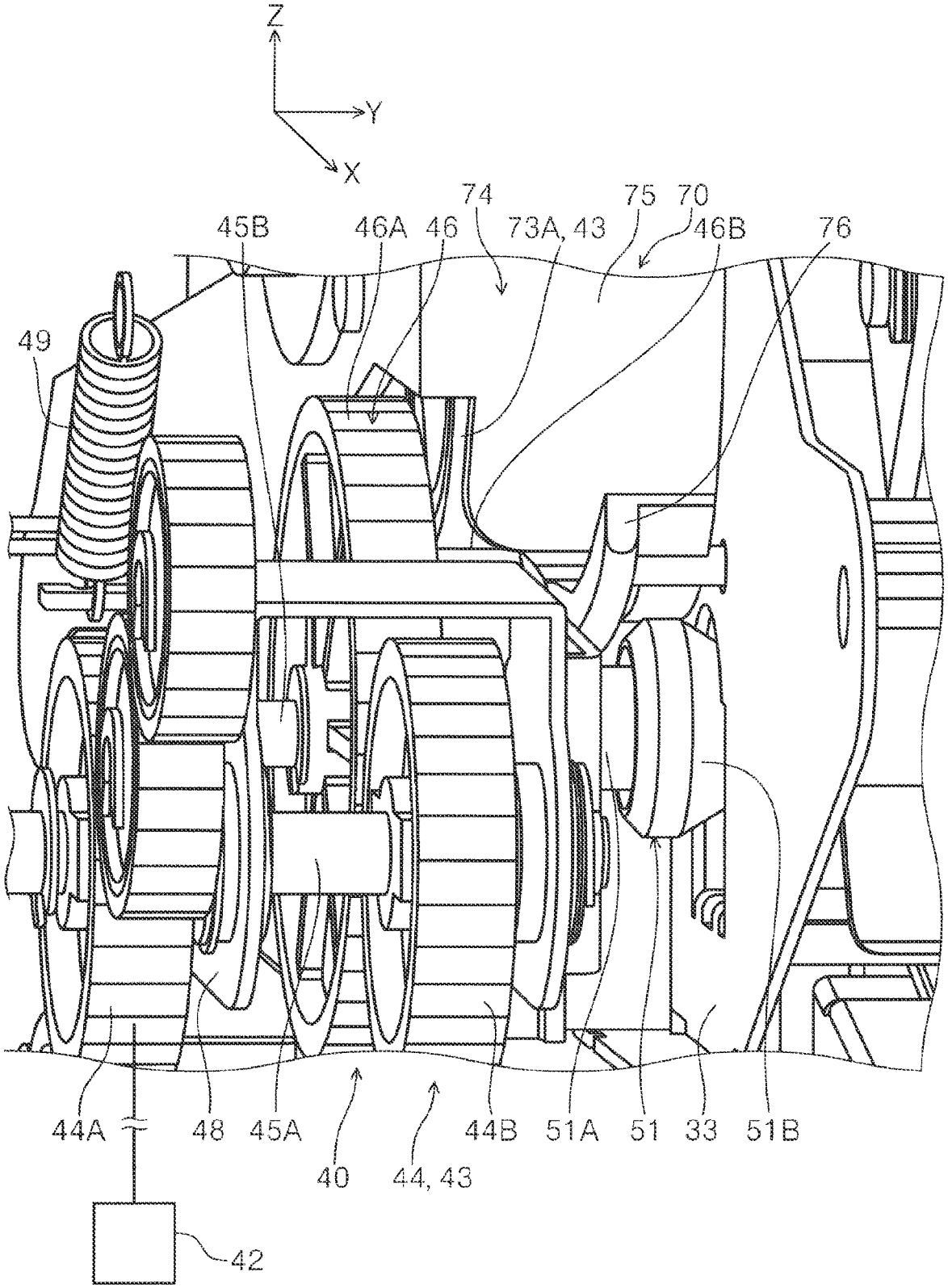
FIG. 5 is a perspective view of part of the drive transmission unit according to the embodiment.

As illustrated in FIGS. 2 and 5, the body drive unit 40 is provided, for example, at an end portion in the −X direction of the apparatus body 12 (FIG. 1). The body drive unit 40 includes a motor 42, a first drive gear train 44, a planetary gear 46, a holder 48, an extension spring 49, and a contacted member 51. In the present embodiment, the body drive unit 40 is included in a drive transmission unit 70.

The motor 42 is an example of a drive source and drives a rotation shaft 78 to rotate a cam member 82 and a cam member 83 (FIG. 4) which are described later.

As illustrated in FIG. 5, the first drive gear train 44 and a second drive gear train 72 (FIG. 2) described later together compose a drive gear train 43. The first drive gear train 44 includes a transmission gear 44A and a transmission gear 44B. The driving force transmitted from the motor 42 to the transmission gear 44A is transmitted from the transmission gear 44A to the planetary gear 46 via the transmission gear 44B.

The holder 48 is swingable on a support shaft 45A extending along the Y direction. The support shaft 45A is supported by a frame (not illustrated) of the apparatus body (FIG. 1). The transmission gears 44A and 44B are attached to the support shaft 45A. At a portion of the holder 48 opposite from the portion, where the support shaft 45A is provided, is provided with a rotatable support shaft 45B extending along the Y direction.

The holder 48 is an example of a holding portion and holds the planetary gear 46 such that the planetary gear 46 is swingable between a first position and a second position. At the first position, the planetary gear 46 engages with a transmission gear 73A which is part of the drive gear train 43 and described later. At the second position, the planetary gear 46 does not engage with the transmission gear 73A.

The planetary gear 46 is provided on the support shaft 45B and can rotate on its axis which is the support shaft 45B. The planetary gear 46 is composed of the gears 46A and 46B having the same center axis.

The gear 46A is engaged with the transmission gear 44B. With this configuration, the planetary gear 46 can orbit around the transmission gear 44B along the outer periphery of the transmission gear 44B while rotating on its axis.

The gear 46B has an outer diameter smaller than that of the gear 46A and protrudes in the +Y direction from the end face in the +Y direction of the gear 46A. The gear 46B can engage with the transmission gear 73A described later.

The extension spring 49 has one end hooked on a portion of the holder 48 and the other end hooked on a frame (not illustrated). When the position of the planetary gear 46 moves down in the −Z direction, the tensile force of the extension spring 49 is applied to the holder 48 so that the planetary gear 46 seeks to move in the +Z direction.

The contacted member 51 has a hollow cylindrical shaft portion 51A and a large diameter portion 51B having a larger diameter than the shaft portion 51A at the end portion in the −X direction of the shaft portion 51A. The shaft portion 51A is attached to an end portion in the +Y direction of the support shaft 45B. The large diameter portion 51B is disposed such that it can be in contact with a projecting portion 76 described later in the Y direction and the Z direction.

When the projecting portion 76 moves in the Y direction and gets over the large diameter portion 51B while being in contact with the large diameter portion 51B, the large diameter portion 51B receives a force in the −Z direction from the projecting portion 76. With this operation, the support shaft 45B moves in the −Z direction, and the gear 46A orbits around. Thereby the planetary gear 46 moves in the −Z direction. After the projecting portion 76 has got over the large diameter portion 51B, the projecting portion 76 is not in contact with the shaft portion 51A. Thus, the planetary gear 46 moves in the +Z direction and engages with the transmission gear 73A.

As illustrated in FIG. 1, the plurality of sheet cassettes 14 store sheets P. The sheets P stored in the sheet cassette 14 are transported by a pick roller 16 and pairs of transporting rollers 17 and 18 along the transporting path T. A transportation path T1 through which sheets P are transported from an external apparatus (not illustrated) and a transportation path T2 through which sheets P are transported from a manual tray 19 provided to the apparatus body 12 via a feeding roller 66 described later merge into the transporting path T. The portion of the printer 10 on the −X direction side from the center in the X direction forms the transportation unit 20 that transports sheets P.

The feeding unit 50 is provided at an end portion in the −X direction of the printer 10 around the manual tray 19. The sheets P on the manual tray 19 are fed along the transportation path T2 by the feeding unit 50, and then transported along the transporting path T by the transportation unit 20. Details of the feeding unit 50 will be described later.

The transportation unit 20 includes a transportation belt 22 stretched on two pulleys 21, a pair of registration rollers 23 that perform skew correction on sheets P, a plurality of pairs of transporting rollers 24 that transport sheets P, a plurality of flaps 25 that switch transportation paths of sheets P, and a medium width sensor 26 that detects the widths in the Y direction of sheets P. Downstream of the transportation belt 22 on the transporting path T are provided transportation paths T3 toward the discharge portion 13 and the inversion path T4 for inverting the front and back of the sheet P.

The apparatus body 12 has an ink tank 27 that stores ink Q and a control unit 29 that controls the operation of each unit in the printer 10.

The line head 28 is located at a position that is downstream of the medium width sensor 26 in the direction to transport sheets P and that faces the transportation belt 22. The line head 28 is an example of a printing unit and performs printing by ejecting ink Q supplied from the ink tank 27 onto the sheet P fed from the feeding unit 50.

The control unit 29 includes a central processing unit (CPU), read only memory (ROM), random access memory (RAM), and a storage, which are not illustrated, and controls transportation of sheets P in the printer 10 and the operation of the units in the printer 10 including the line head 28, the transportation unit 20, and the feeding unit 50.

As illustrated in FIG. 2, the feeding unit 50 is an example of a feeding device that feeds sheets P to the line head 28 (FIG. 1). The feeding unit 50 includes, for example, a frame unit 52, the drive transmission unit 70, an extension spring 61 (FIG. 4), a hopper plate 62, and the feeding roller 66. Details of the drive transmission unit 70 will be described later. The hopper plate 62 is disposed to be directed to the feeding roller 66 and side by side with the manual tray 19 (FIG. 1).

In the feeding unit 50, the transportation direction in which sheets P are transported is defined as the +A direction. The +A direction is an oblique direction toward the +X direction and the −Z direction. The direction orthogonal to the +A direction as seen from the Y direction and directed toward the +X direction and the +Z direction is defined as the +B direction. The +B direction corresponding to the loading direction of the manual tray 19 in which a plurality of sheets P are loaded. The direction opposite from the +A direction is defined as the −A direction, and the direction opposite from the +B direction as the −B direction.

Figure 4:
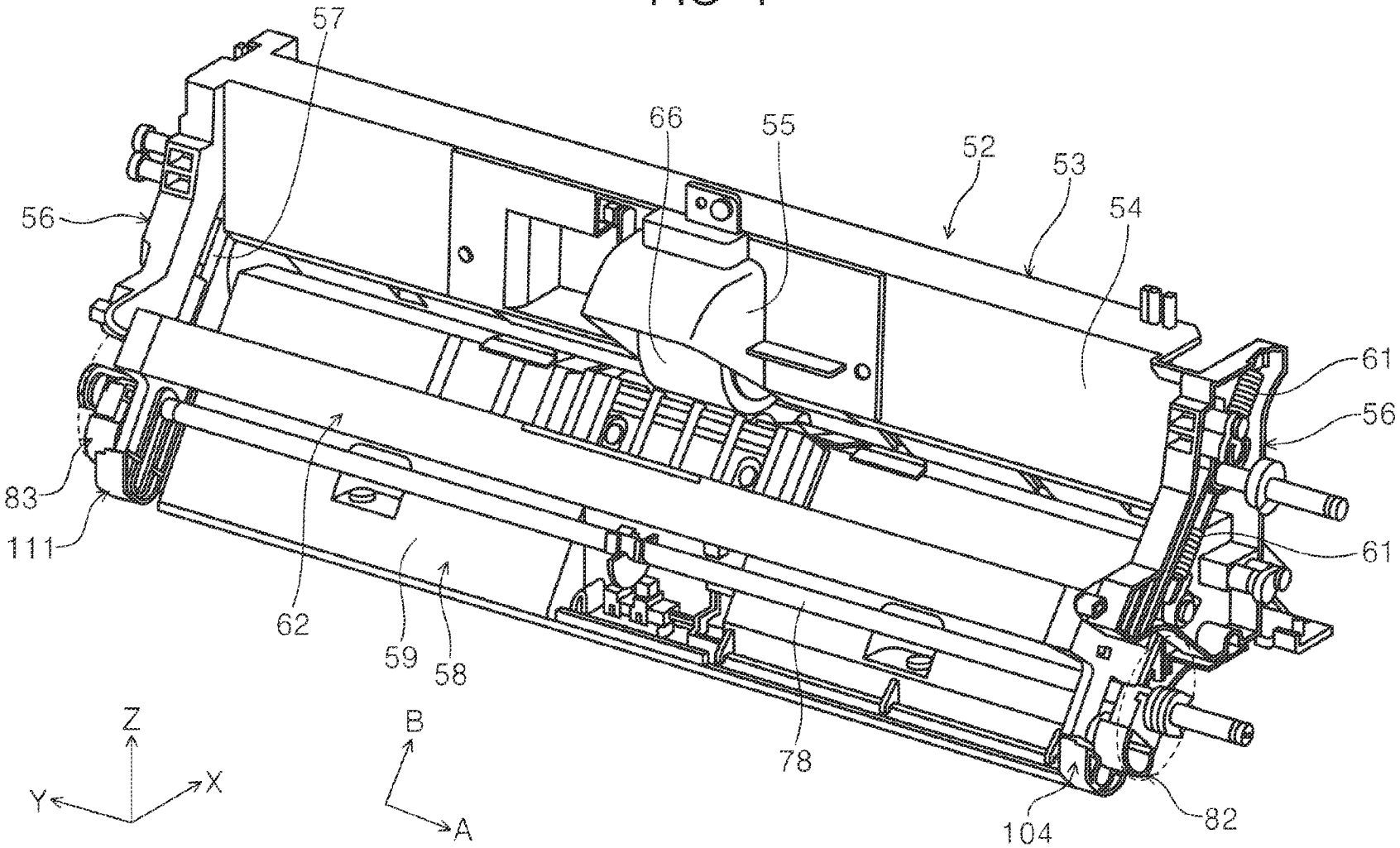
FIG. 4 is a perspective view of part of the feeding unit according to the embodiment.

As illustrated in FIG. 4, the frame unit 52 includes one upper frame 53, two side frames 56, and one lower frame 58. The one upper frame 53 and the two side frames 56 have a unitary structure.

The upper frame 53 extends in the Y direction and includes a longitudinal wall 54 standing upright along the Y-Z plane. The longitudinal wall 54 is provided with a protection cover 55 that protects the feeding roller 66 by covering part of it.

The side frames 56 extend in the −B direction from both end portions in the Y direction of the upper frame 53. The side frame 56 has a guide groove 57. The guide groove 57 is a portion recessed outward in the Y direction and extending obliquely upward from an end portion in the −B direction of the side frame 56 toward the +B direction.

The extension spring 61 has one end attached to the side frame 56 and the other end attached to a cam follower 104 described later. With this configuration, the extension spring 61 exerts a tensile force acting in the +B direction along the guide groove 57 on the cam follower 104. In other words, the extension spring 61 is an example of a pressing portion and presses the cam follower 104 against a first cam 86 and a second cam 96 (FIG. 6) of the cam member 82 described later.

The lower frame 58 is disposed at a position in the −Z direction relative to the upper frame 53 and extends in the Y direction. The lower frame 58 includes a slanted wall 59 slanted to be adapted to the extending direction of the guide groove 57.

When a sheet P is mounted on the hopper plate 62 described later, the end portion of the sheet P is in contact with the slanted wall 59, and thus the end in the +A direction of sheet P is positioned by the slanted wall 59. In addition, when a plurality of sheets P are mounted on the hopper plate 62, the end portions in the +A direction of the sheets P are lined up.

Figure 3:
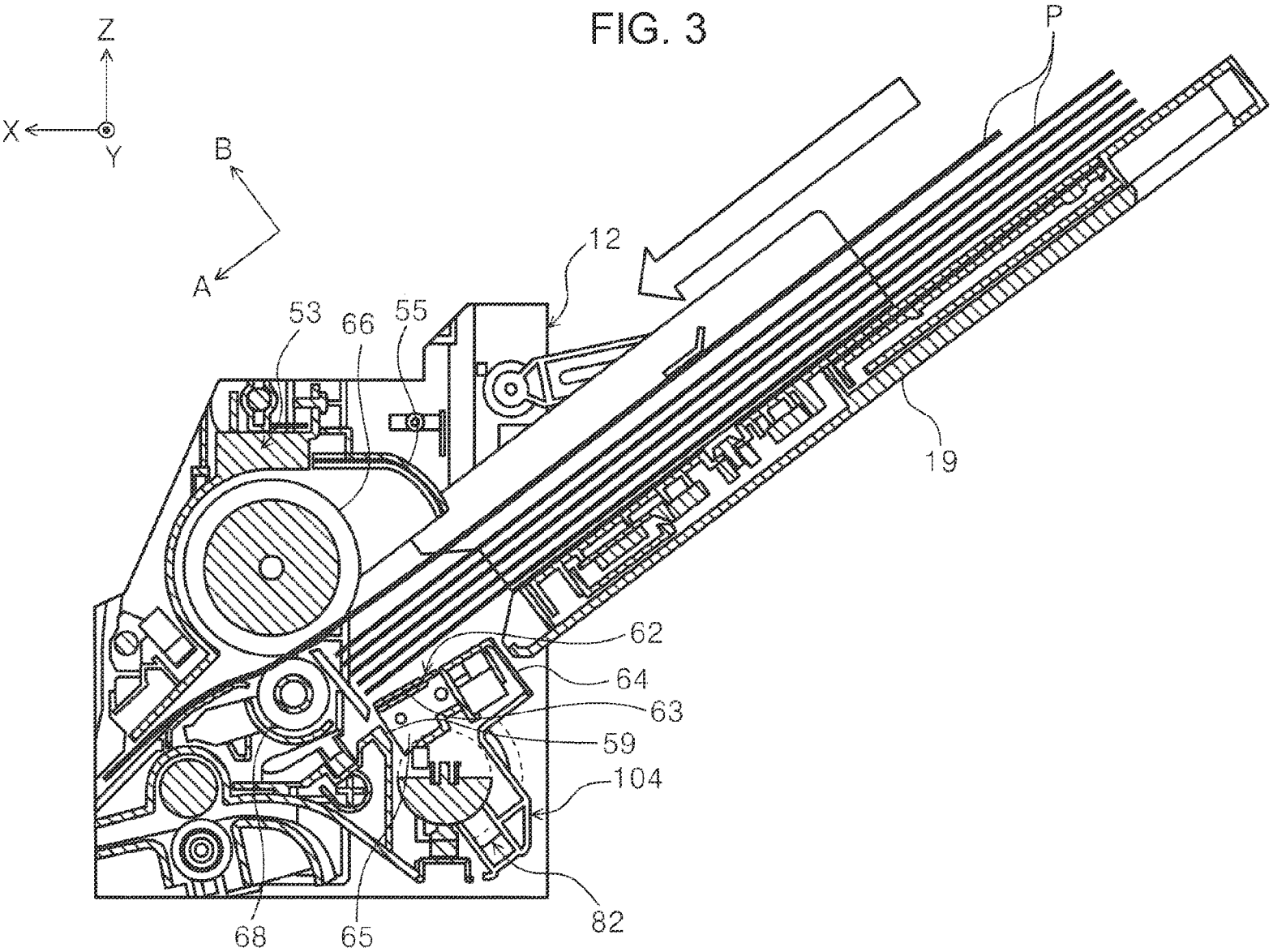
FIG. 3 is a longitudinal sectional view of the feeding unit according to the embodiment with a lift plate lifted down.

As illustrated in FIG. 3, the hopper plate 62 is an example of a lift member and is lifted up and down along with the movement of the cam follower 104 described later from one of a feeding position and a retreat position to the other. At the feeding position, sheets P can be fed, and the retreat position is away in the −B direction from the feeding position. Specifically, the hopper plate 62 includes an upper plate portion 63 extending substantially in the +A direction toward the slanted wall 59, a front plate portion 64 extending in the −B direction from an end portion in the −A direction of the upper plate portion 63, and part-receiving portions 65 formed at both end portions in the Y direction of the upper plate portion 63.

The feeding roller 66 is provided at the center portion in the Y direction of the upper frame 53 so as to be rotatable on the center shaft extending along the Y direction. When the hopper plate 62 is at the feeding position, the feeding roller 66, while rotating, feeds the sheets P on the hopper plate 62 in the +A direction. Note that in the +A direction, downstream of the position at which the sheet P is pinched by the feeding roller 66 and the hopper plate 62 is provided a rotatable auxiliary roller 68.

As illustrated in FIG. 2, the drive transmission unit 70 is an example of a drive transmission device. The drive transmission unit 70 includes the drive gear train 43, the rotation shaft 78, the cam member 82, the motor 42 (FIG. 5), the cam follower 104, and the extension spring 61 (FIG. 4).

The drive gear train 43 includes the first drive gear train 44 and the second drive gear train 72 which have been already mentioned. The drive gear train 43 transmits a driving force from the motor 42 to the rotation shaft 78.

The second drive gear train 72 includes transmission gears 73A, 73B, 73C, and 73D. The transmission gears 73A, 73B, 73C, and 73D have axes extending in the Y direction and are rotatably provided on a body frame 33. The driving force transmitted from the motor 42 via the transmission gears 44A and 44B and the planetary gear 46 to the transmission gear 73A is transmitted from the transmission gear 73A via the transmission gears 73B, 73C, and 73D to the rotation shaft 78 and the cam member 82.

As illustrated in FIG. 5, the transmission gear 73A is engaged with the gear 46B of the planetary gear 46. The transmission gear 73A is covered with a cover member 74 except the portion where the transmission gear 73A is engaged with the gear 46B.

The cover member 74 has a peripheral wall portion 75 having an arc shape as viewed from the Y direction and the projecting portion 76 projecting outward from a portion of the peripheral wall portion 75.

When the door portion 32 (FIG. 1) is opened or closed, the projecting portion 76 slides in an arc shape in the X-Y plane. The projecting portion 76, while sliding, is not in contact with the shaft portion 51A but is in contact with the large diameter portion 51B. The projecting portion 76 in contact with the large diameter portion 51B lowers the large diameter portion 51B in the −Z direction. This lowers the planetary gear 46 in the −Z direction.

As illustrated in FIG. 2, the rotation shaft 78 is located at a position in the −A direction relative to the lower frame 58 and extends in the Y direction. The rotation shaft 78 is longer than the lower frame 58 in the Y direction. At the end portion in the −Y direction of the rotation shaft 78 are attached the cam member 82 and the transmission gear 73D. At the end portion in the +Y direction of the rotation shaft 78 is attached the cam member 83 (FIG. 4).

Each of the cam member 82 and the cam member 83 is an example of a cam portion and rotates about the rotation shaft 78. The cam member 82 and the cam member 83 are formed symmetrically with respect to the center in the Y direction of the rotation shaft 78. The cam member 83 comes into contact with a cam follower 111 formed symmetrically to the cam follower 104 described later. Thus, in the following, the cam member 82 and the cam follower 104 will be described, and description of the cam member 83 and the cam follower 111 will be omitted.

At the center in the Y direction of the rotation shaft 78 is attached a semicircular detection plate 79 for detecting the rotation phase of the cam member 82. The detection plate 79 is detected by an optical sensor 81 provided on the lower frame 58.

Figure 6:
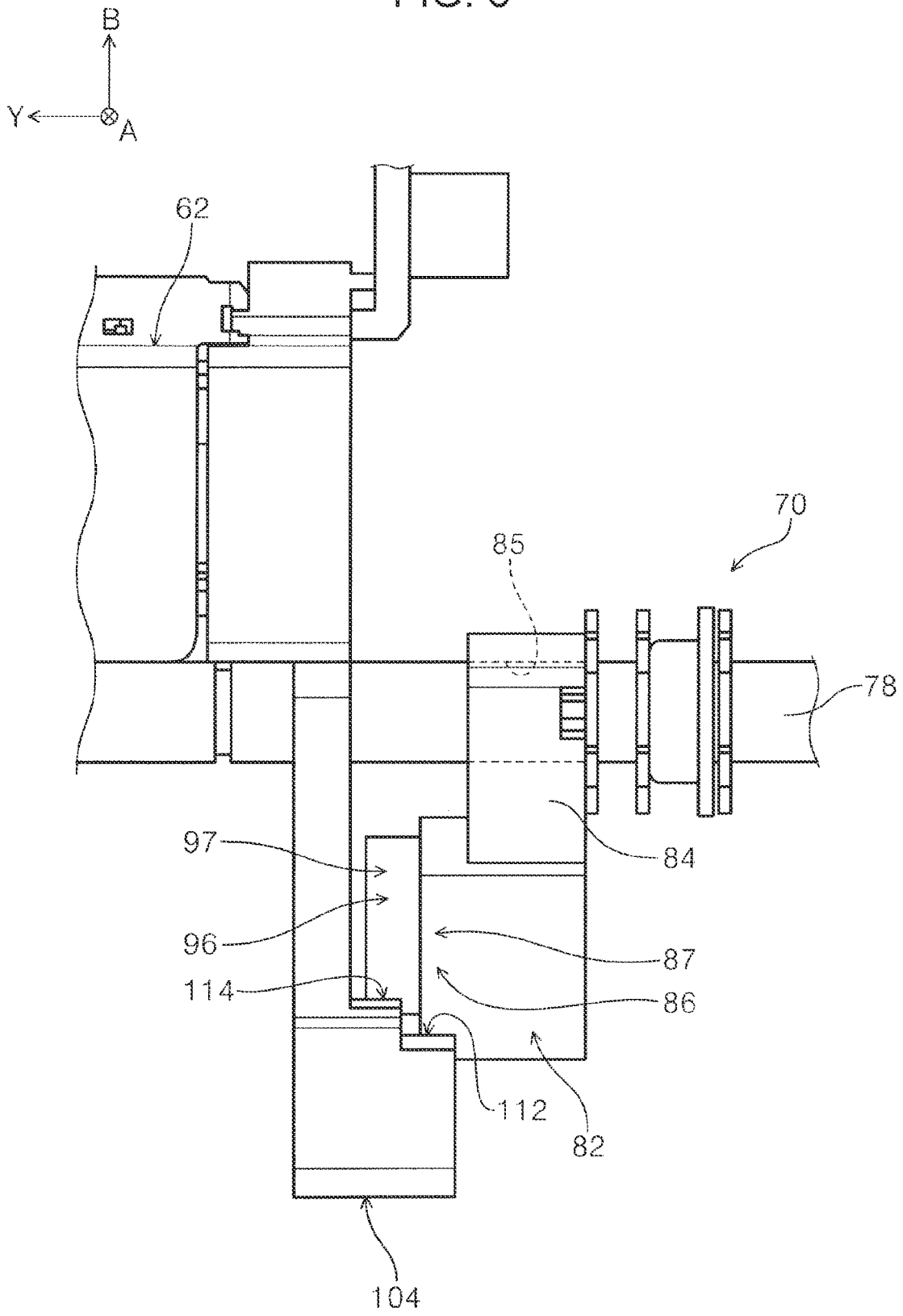
FIG. 6 is a side view of the drive transmission unit according to the embodiment.
Figure 7:
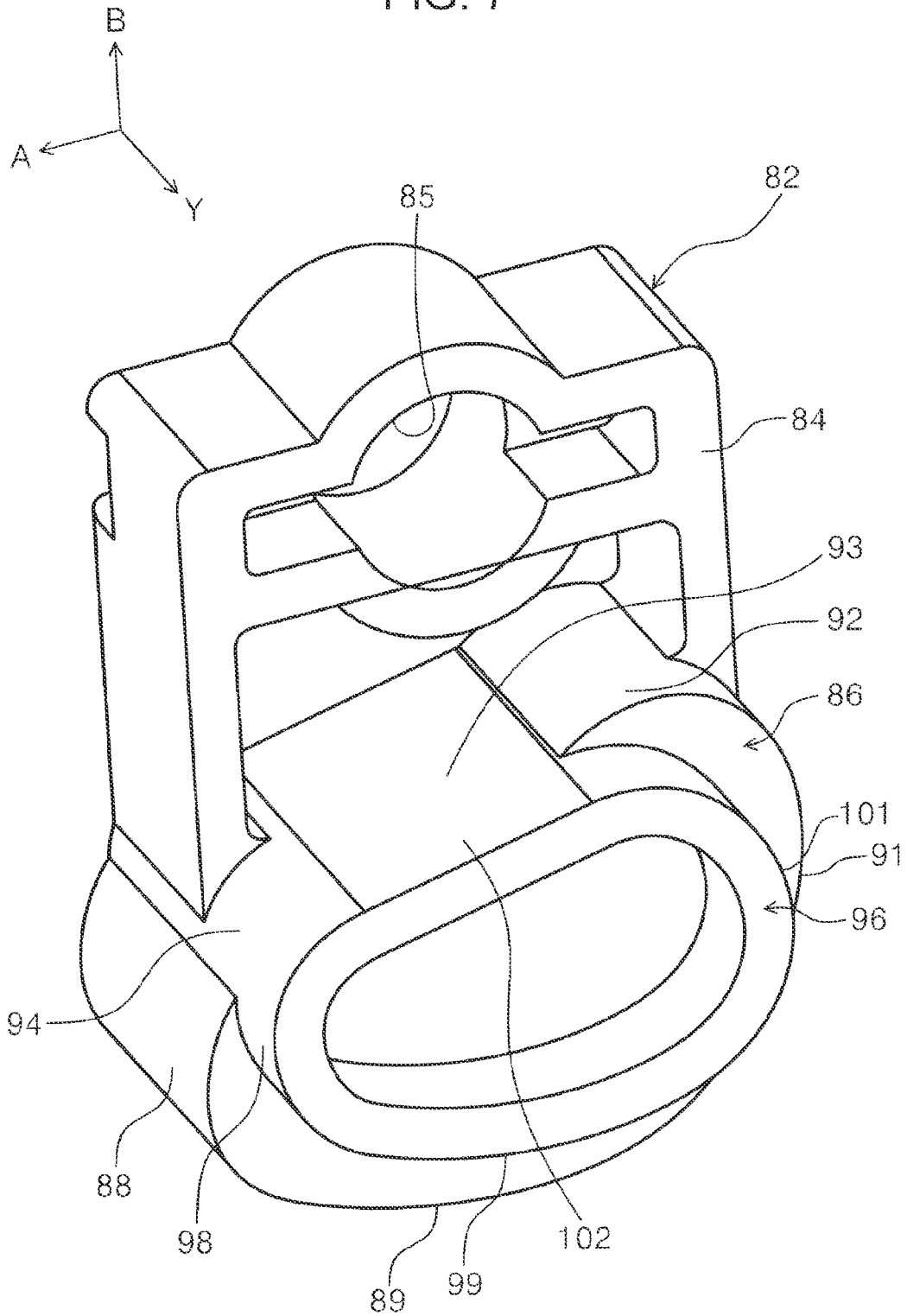
FIG. 7 is a perspective view of a composite cam of the drive transmission unit according to the embodiment.

As illustrated in FIGS. 6 and 7, the cam member 82 has, for example, a base portion 84 extending in the +B direction, the first cam 86, and the second cam 96. The first cam 86 protrudes in the +Y direction from a portion of the base portion 84 in the −B direction relative to its center in the +B direction. The second cam protrudes in the +Y direction from the first cam 86. The base portion 84, the first cam 86, and the second cam 96 are integrally formed.

The base portion 84 has, at its upper end portion in the +B direction, a through hole 85 passing through the base portion 84 in the Y direction. Into the through hole 85, the end portion in the −Y direction of the rotation shaft 78 is inserted. The base portion 84 is fixed to the rotation shaft 78 with the rotation shaft 78 inserted in the through hole 85. With this configuration, when the rotation shaft 78 is rotated, the cam member 82 is rotated integrally with the rotation shaft 78.

Figure 11A:
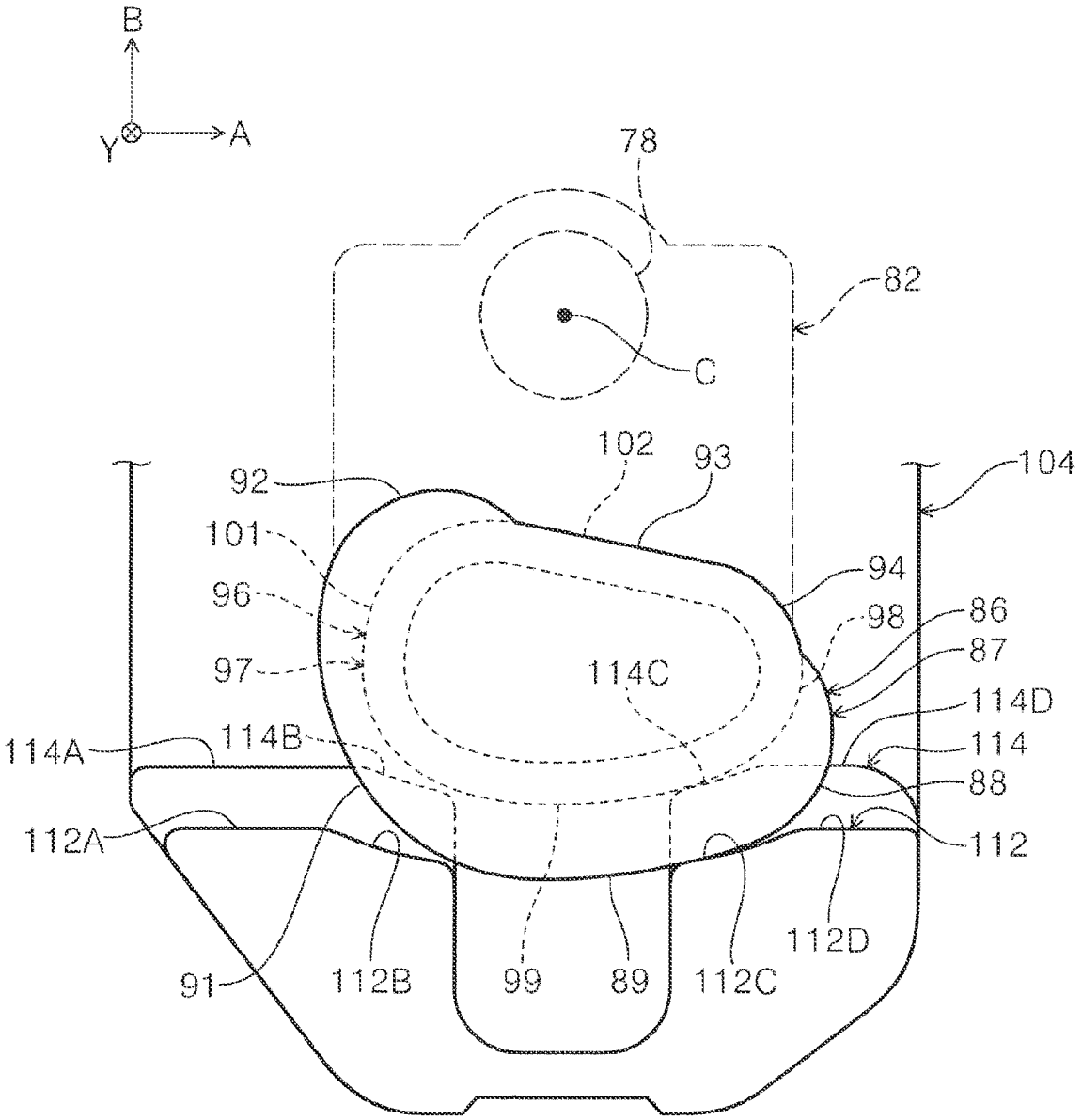
FIG. 11A is a front view of the composite cam and the cam follower according to the embodiment at the time when the cam rotation angle of the composite cam is 0°.

As illustrated in FIG. 11A, the first cam 86 rotates about the rotation shaft 78. The first cam 86 defines the maximum distance between the cam follower 104 and the rotation shaft 78. In addition, the first cam 86 has an outer peripheral surface 87 as an example of an outer edge portion. The first cam 86 is illustrated in transparent view from a position in the −Y direction toward the +Y direction. Here, for example, the outer peripheral surface 87 is divided into a plurality of cam surfaces to describe the outer peripheral surface 87. The following description of the outer peripheral surface 87 is based on the arrangement of the outer peripheral surface 87 at the time when the cam follower 104 is at the position farthest in the −B direction.

The outer peripheral surface 87 includes, for example, cam surfaces 88, 89, 91, 92, 93, and 94 arranged in order in the clockwise direction. The cam surface 88 is an arc-shaped surface forming an end portion in the A direction of the outer peripheral surface 87. The cam surface 89 is a surface to which the distance from the rotation center C of the rotation shaft 78 is substantially equal in the circumferential direction. The cam surface 91 is a surface having a curvature radius larger than that of the cam surface 88. The cam surface 92 is a surface having a curvature radius smaller than that of the cam surface 91. The cam surface 93 is a substantially planar surface. The cam surface 94 is a curved surface extending between the cam surface 93 and the cam surface 88.

The second cam 96 rotates about the rotation shaft 78. The second cam 96 has an outer peripheral surface 97 as an example of an inner edge portion. The second cam 96 is illustrated in transparent view from a position in the −Y direction toward the +Y direction. Here, for example, the outer peripheral surface 97 is divided into a plurality of cam surfaces to describe the outer peripheral surface 97. The following description of the outer peripheral surface 97 is based on the arrangement of the outer peripheral surface 97 at the time when the cam follower 104 is at the position farthest in the −B direction.

The outer peripheral surface 97 is positioned closer to the rotation shaft 78 than the outer peripheral surface 87 of the first cam 86. The outer peripheral surface 97 includes, for example, cam surfaces 98, 99, and 101 and a cam surface 102 which is not included in the outer peripheral surface 97, the cam surfaces 98, 99, 101, and 102 being arranged in order in the clockwise direction.

The cam surface 98 is an arc-shaped surface forming an end portion in the +A direction of the outer peripheral surface 97.

The cam surface 99 is a surface to which the distance from the rotation center C of the rotation shaft 78 is substantially equal in the circumferential direction. The cam surface 99 is an arc-shaped surface forming an end portion in the −B direction of the outer peripheral surface 97. The curvature radius of the cam surface 99 is larger than that of the cam surface 98. The cam surface 99 is positioned in the +B direction relative to the cam surface 89.

The cam surface 101 is an arc-shaped surface forming an end portion in the −A direction of the outer peripheral surface 97. The cam surface 101 is a surface having a curvature radius smaller than that of the cam surface 99 and larger than that of the cam surface 98.

The cam surface 102 is a substantially planar surface, has a length in the +A direction equal to the length in the +A direction of the cam surface 93, and is positioned side by side with the cam surface 93 in the Y direction. In other words, the cam surface 102 is not positioned closer to the rotation shaft 78 than the outer peripheral surface 87, and thus it is not included in the outer peripheral surface 97.

Figure 8:
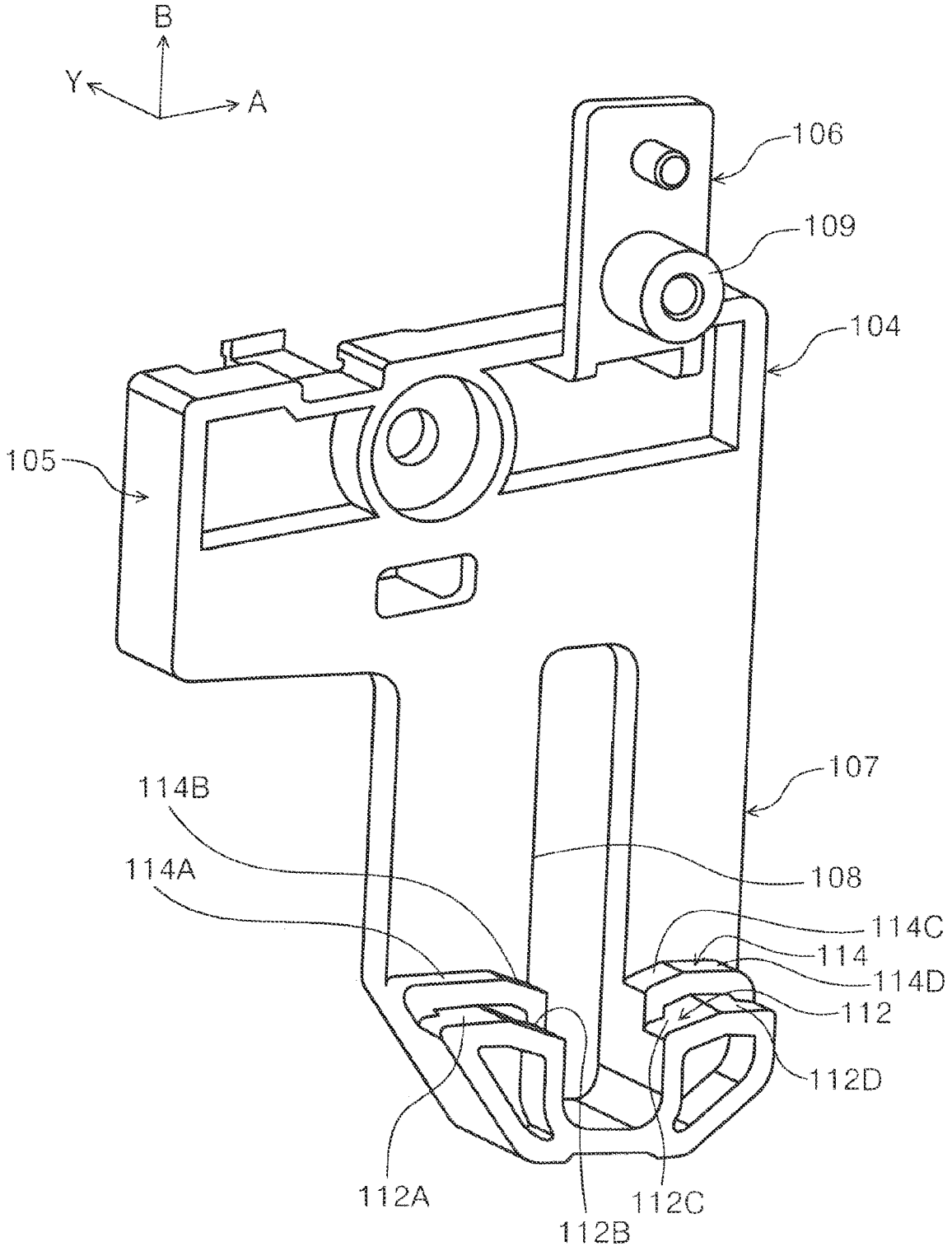
FIG. 8 is a perspective view of a cam follower of the drive transmission unit according to the embodiment.

As illustrated in FIG. 8, the cam follower 104 is a member including an attachment portion 105, a guided portion 106, an extension portion 107, a guide hole 108, a second contact portion 114, and a first contact portion 112, which are integrally formed. The cam follower 104 comes into contact with the cam member 82 and is moved by the rotation of the cam member 82 in the +B direction to be close to the rotation shaft 78 and in the −B direction to be away from the rotation shaft 78. The +B direction is an example of a first direction. The −B direction is an example of a second direction.

When the cam follower 104 is moved in the −B direction by the rotation of the cam member 82, this operation includes contact between the outer peripheral surface 97 of the second cam 96 and the cam follower 104.

When the cam follower 104 is moved in the +B direction by the rotation of the cam member 82, this operation includes contact between the outer peripheral surface 97 and the cam follower 104.

The description of the arrangement of each portion of the cam follower 104 is based on the arrangements and directions in the state in which the cam follower 104 stands upright along the +B direction.

The attachment portion 105 is formed in a rectangular plate shape in which the dimension in the +A direction is longer than the dimension in the +B direction. The attachment portion 105 is attached to the part-receiving portion 65 positioned in the −Y direction of the hopper plate 62 (FIG. 3) by using a screw (not illustrated).

The guided portion 106 is a plate-shaped portion extending in the +B direction from a portion positioned in the +B direction and the +A direction in the attachment portion 105. The guided portion 106 is inserted in the guide groove 57 (FIG. 4) to be movable along the guide groove 57. The guided portion 106 has a protrusion 109 formed to protrude in the −Y direction. The end portion in the −B direction of the extension spring 61 (FIG. 4) is hooked to the protrusion 109. With this configuration, the tensile force of the extension spring 61 acts on the cam follower 104.

The extension portion 107 is a plate-shaped portion extending in the −B direction from the end portion in the −B direction of the attachment portion 105.

The guide hole 108 passes through the extension portion 107 in the Y direction. The guide hole 108 extends in the +B direction in the center portion in the +A direction of the extension portion 107. The rotation shaft (FIG. 4) is inserted in the guide hole 108. When the cam follower 104 is moved, the hole walls of the guide hole 108 is not in contact with the rotation shaft 78. In other words, the movement of the cam follower 104 is not restricted by the rotation shaft 78.

The second contact portion 114 is a portion positioned at the end portion in the −B direction of the extension portion 107 and protruding in the −Y direction from the extension portion 107. The second contact portion 114 is a portion that can be in contact with the outer peripheral surface 97 (FIG. 11A). Specifically, the second contact portion 114 includes contact surfaces 114A, 114B, 114C, and 114D. The contact surfaces 114A, 114B, 114C, and 114D are formed at end portions in the +B direction of the second contact portion 114. The contact surfaces 114A, 114B, 114C, and 114D are arranged from the −A direction toward the +A direction in this order.

The first contact portion 112 is a portion protruding in the −Y direction from the second contact portion 114. The first contact portion 112 is a portion that can be in contact with the outer peripheral surface 87 (FIG. 11A). Specifically, the first contact portion 112 includes contact surfaces 112A, 112B, 112C, and 112D. The contact surfaces 112A, 112B, 112C, and 112D are formed at end portions in the +B direction of the first contact portion 112. The contact surfaces 112A, 112B, 112C, and 112D are arranged from the −A direction toward the +A direction in this order. The positions in the +B direction of the contact surfaces 112A, 112B, 112C, and 112D are lower than the positions in the +B direction of the contact surfaces 114A, 114B, 114C, and 114D.

Figure 9:
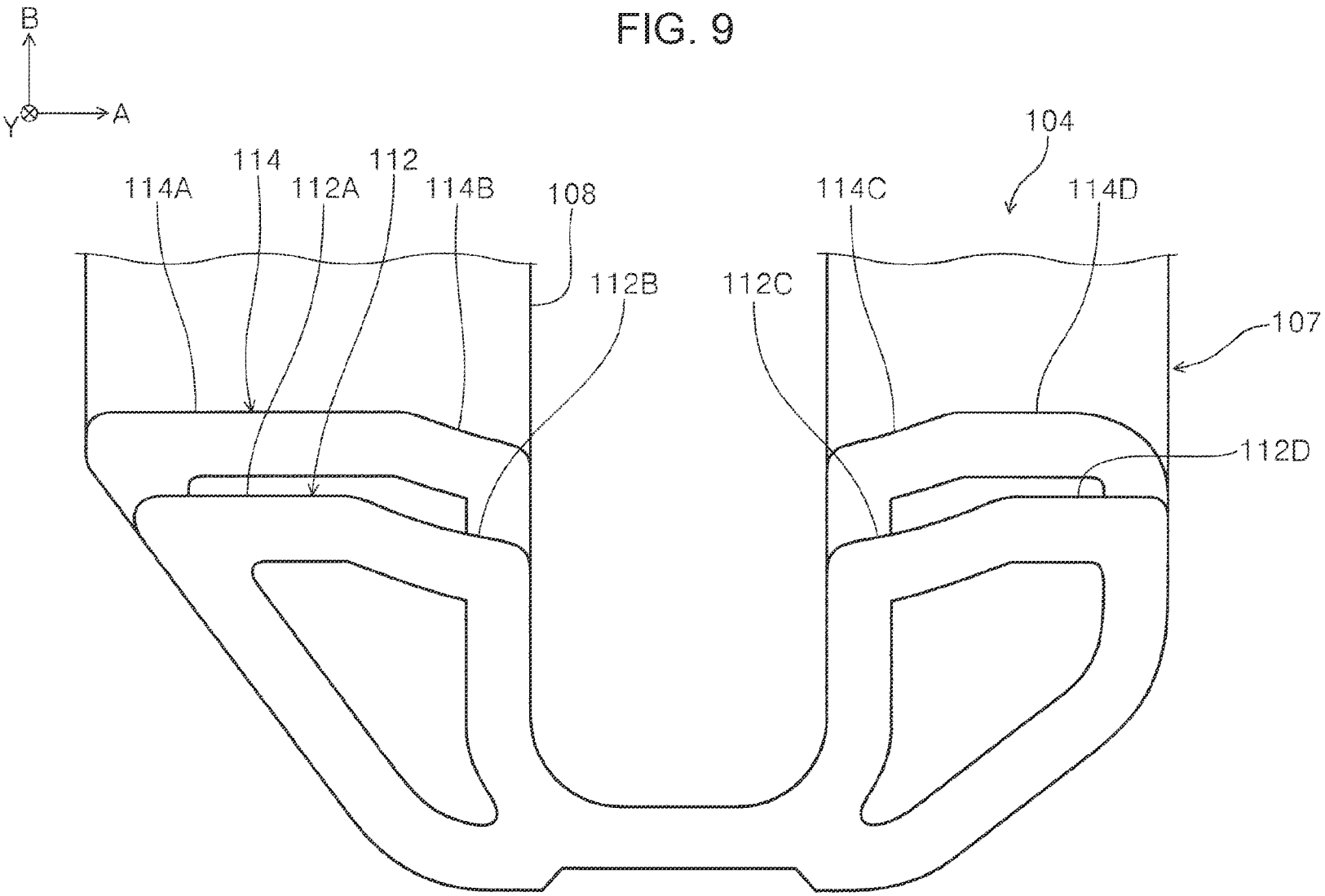
FIG. 9 is an enlarged front view of part of the cam follower according to the embodiment.

As illustrated in FIG. 9, the contact surfaces 114A and 114B are positioned in the −A direction relative to the guide hole 108. The contact surfaces 114C and 114D are positioned in the +A direction relative to the guide hole 108.

The contact surface 114A is a substantially planar surface extending along the A-Y plane. The contact surface 114B extends obliquely downward from the end portion in the +A direction of the contact surface 114A toward a position in the +A direction and in the −B direction. The contact surface 114B is a curved surface that is formed to have a recess open in the +B direction.

The contact surface 114C is positioned to have the same height in the +B direction as the contact surface 114B. The contact surface 114C extends obliquely upward from an edge portion of the guide hole 108 toward a position in the +A direction and in the +B direction. The contact surface 114C is a curved surface that is formed to have a recess open in the +B direction. The contact surface 114D extends in the +A direction from the end portion in the +A direction of the contact surface 114C. The contact surface 114D is a substantially planar surface extending along the A-Y plane. The height in the +B direction of the contact surface 114D is designed to be the same as the height in the +B direction of the contact surface 114A.

The contact surfaces 112A and 112B are positioned in the −A direction relative to the guide hole 108. The contact surfaces 112C and 112D are positioned in the +A direction relative to the guide hole 108. The contact surface 112A is a substantially planar surface extending along the A-Y plane. The contact surface 112B extends obliquely downward from the end portion in the +A direction of the contact surface 112A toward a position in the +A direction and in the −B direction. The contact surface 112B is a curved surface that is formed to have a recess open in the +B direction.

The contact surface 112C is positioned to have the same height in the Z direction as the contact surface 112B. The contact surface 112C extends obliquely upward from an edge portion of the guide hole 108 toward a position in the +A direction and in the +B direction. The contact surface 112C is a curved surface that is formed to have a recess open in the +B direction. The contact surface 112D extends in the +A direction from the end portion in the +A direction of the contact surface 112C. The contact surface 112D is a substantially planar surface extending along the A-Y plane. The height in the +B direction of the contact surface 112D is designed to be the same as the height in the +B direction of the contact surface 112A.

As illustrated in FIG. 6, in the drive transmission unit 70, when the rotation shaft 78 is rotated in the state in which the outer peripheral surface 87 is in contact with the first contact portion 112, after the rotation shaft 78 starts rotating and by the time when the outer peripheral surface 87 is apart from the first contact portion 112, contact between the outer peripheral surface 97 and the second contact portion 114 starts.

In the drive transmission unit 70, the torque acting on the rotation shaft 78 when the outer peripheral surface 97 is in contact with the second contact portion 114 acts in the direction to move the planetary gear 46 (FIG. 2) from the first position to the second position.

In the drive transmission unit 70, when the rotation shaft 78 is rotated in the state in which the outer peripheral surface 87 is in contact with the first contact portion 112, contact between the outer peripheral surface 97 and the second contact portion 114 starts before the outer peripheral surface 87 is apart from the first contact portion 112.

In the drive transmission unit 70, in one rotation of the rotation shaft 78, contact between the outer peripheral surface 87 and the first contact portion 112 starts before the outer peripheral surface 97 is apart from the second contact portion 114.

Figure 10:
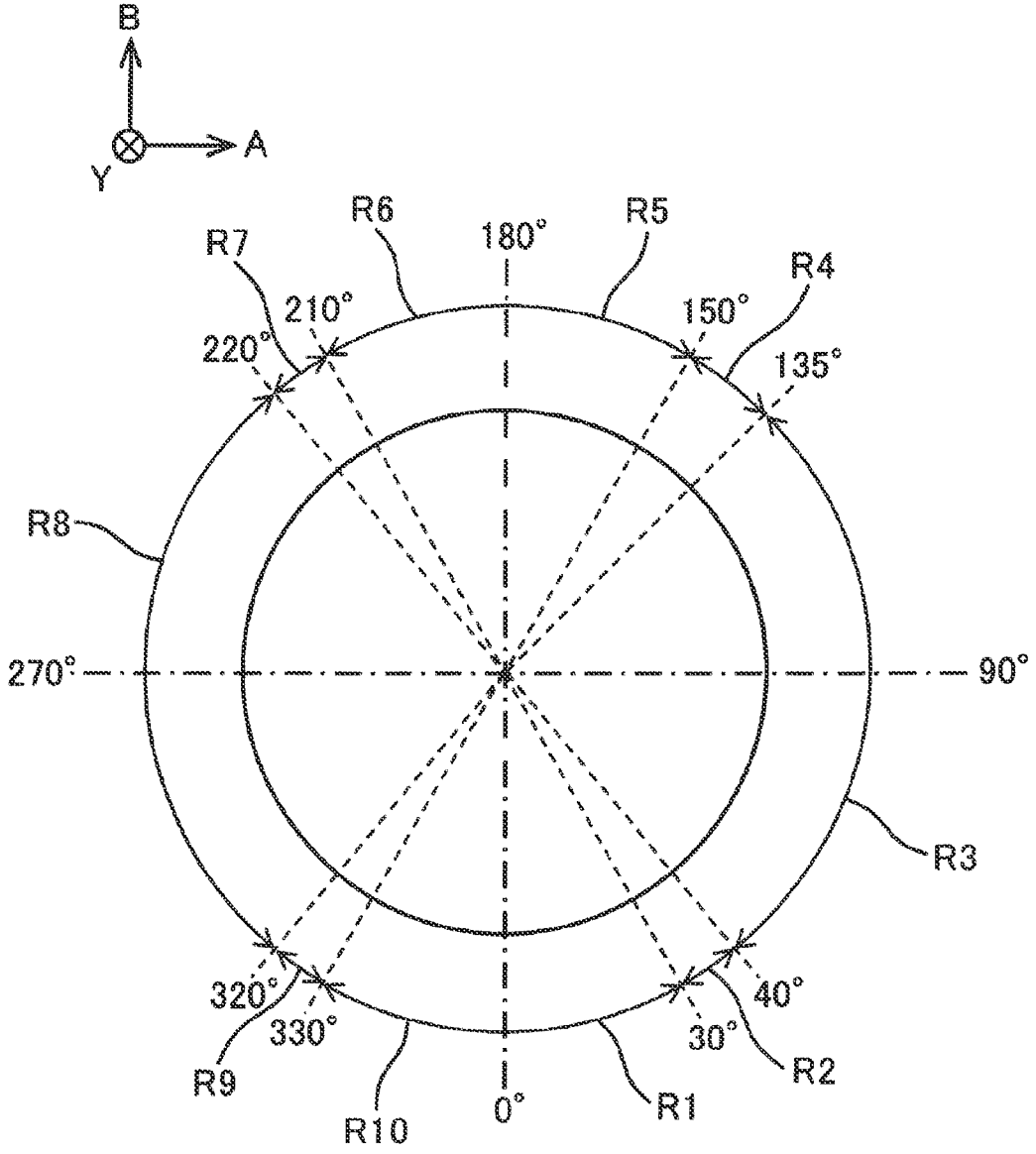
FIG. 10 is a schematic diagram illustrating the cam rotation angle and rotation ranges of the composite cam according to the embodiment.

FIG. 10 illustrates sectors of the rotation ranges when the cam member 82 is rotated once in the counterclockwise direction viewed in the +Y direction. In the figure, the cam rotation angle of the cam member 82 (FIG. 11A) at the time when the cam surface 89 (FIG. 11A) is at the lowest position in the −B direction is defined as 0°. FIG. 10 illustrates the rotation shaft 78 in place of the cam member 82. In the following description, the cam rotation angle is simply referred to as the rotation angle. Note that values of the rotation angles illustrated in FIG. 10 are examples, and hence the rotation angles may be set to angles of other values.

The range larger than or equal to the rotation angle 0° and smaller than 30° is defined as the range R1; the range larger than or equal to the rotation angle 30° and smaller than the rotation angle 40°, the range R2; the range larger than or equal to the rotation angle 40° and smaller than the rotation angle 135°, the range R3; and the range larger than or equal to the rotation angle 135° and smaller than the rotation angle 150°, the range R4. The range larger than or equal to the rotation angle 150° and smaller than the rotation angle 180° is defined as the range R5; the range larger than or equal to the rotation angle 180° and smaller than 210°, the range R6; the range larger than or equal to the rotation angle 210° and smaller than the rotation angle 220°, the range R7; and the range larger than or equal to the rotation angle 220° and smaller than the rotation angle 320°, the range R8. The range larger than or equal to the rotation angle 320° and smaller than 330° is defined as the range R9; and the range larger than or equal to the rotation angle 330° and smaller than the rotation angle 360, in other words, 0°, is defined as the range R10. The range R1 to the range R10 will be used for describing the rotation of the cam member 82 described later.

Figure 15:
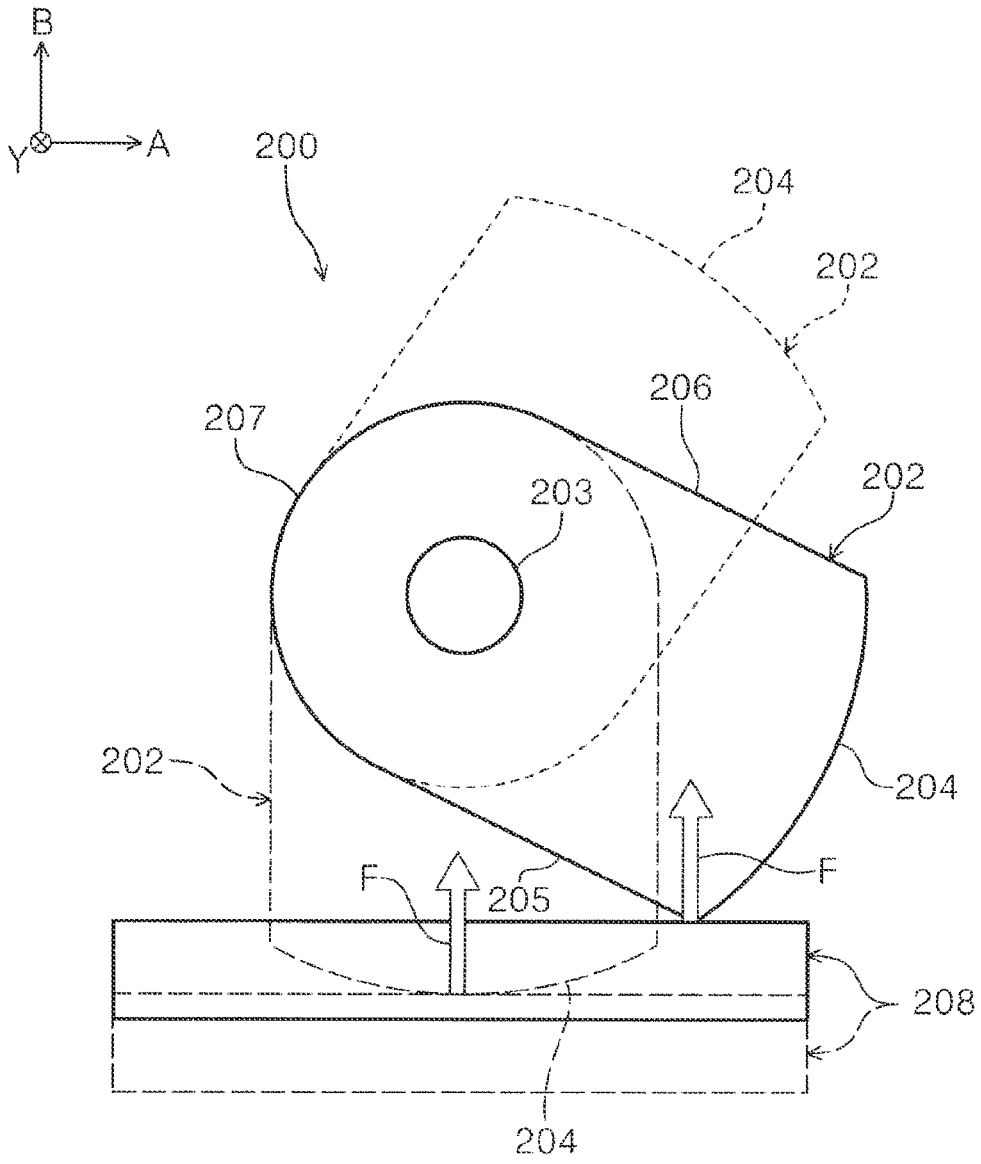
FIG. 15 is a schematic diagram illustrating the load that acts on a single-tier cam according to a comparative example in which the single-tier cam is rotated.

FIG. 15 illustrates a drive transmission unit 200 as a comparative example of present embodiment. The drive transmission unit 200 includes a cam member 202 and a cam follower 208.

The cam member 202 is rotated along with the rotation of a rotation shaft 203 extending along the Y direction. The cam member 202 includes an arc-shaped cam surface 204, planar cam surfaces 205 and 206, and an arc-shaped cam surface 207 having a smaller curvature radius than the cam surface 204.

The cam follower 208 is formed in a plate shape having a certain thickness in the +B direction and is slidable in the +B direction and the −B direction. The cam follower 208 is pulled in the +B direction by using an extension spring (not illustrated). The cam follower 208 is attached to the hopper plate 62 (FIG. 2).

As indicated by the dashed lines as imaginary lines, when a center portion in the circumferential direction of the cam surface 204 is in contact with the cam follower 208, a load F in the +B direction acts on the contact point from the cam follower 208 toward the center of the rotation shaft 203. Here, as the cam member 202 starts to be rotated and the rotation angle increases, the contact point shifts in the +A direction. In this state, the difference between the direction in which the load F acts on the contact point and the direction from the contact point to the center of the rotation shaft 203 increases, and the torque acting on the rotation shaft 203 becomes larger than when the rotation starts. In other words, the load acting on a motor (not illustrated) that drives the cam member 202 increases.

Figure 12:
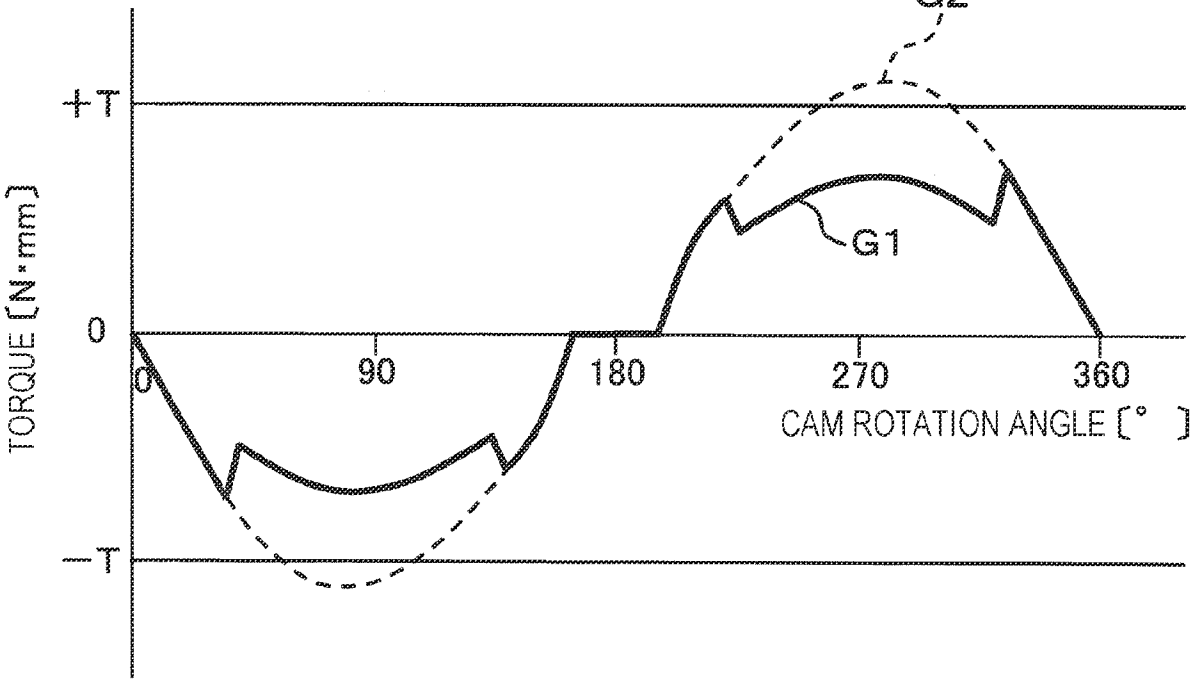
FIG. 12 is a graph illustrating the relationship between the cam rotation angle and torque of the composite cam according to the embodiment.

FIG. 12 illustrates the relationship between the rotation angle and the torque, in which the graph G1 of the solid line shows the case of using the drive transmission unit 70 of the present embodiment, and the graph G2 of the dashed line shows the case of using the drive transmission unit 200 of the comparative example. Note that in the ranges in which the torques of the graph G1 and the graph G2 are substantially the same, illustration of the graph G2 is omitted.

As the graph G2 shows, when using the drive transmission unit 200 of the comparative example, the torque acting on the rotation shaft 203 exceeds the positive allowable torque +T and the negative allowable torque −T in some ranges.

Figure 13:
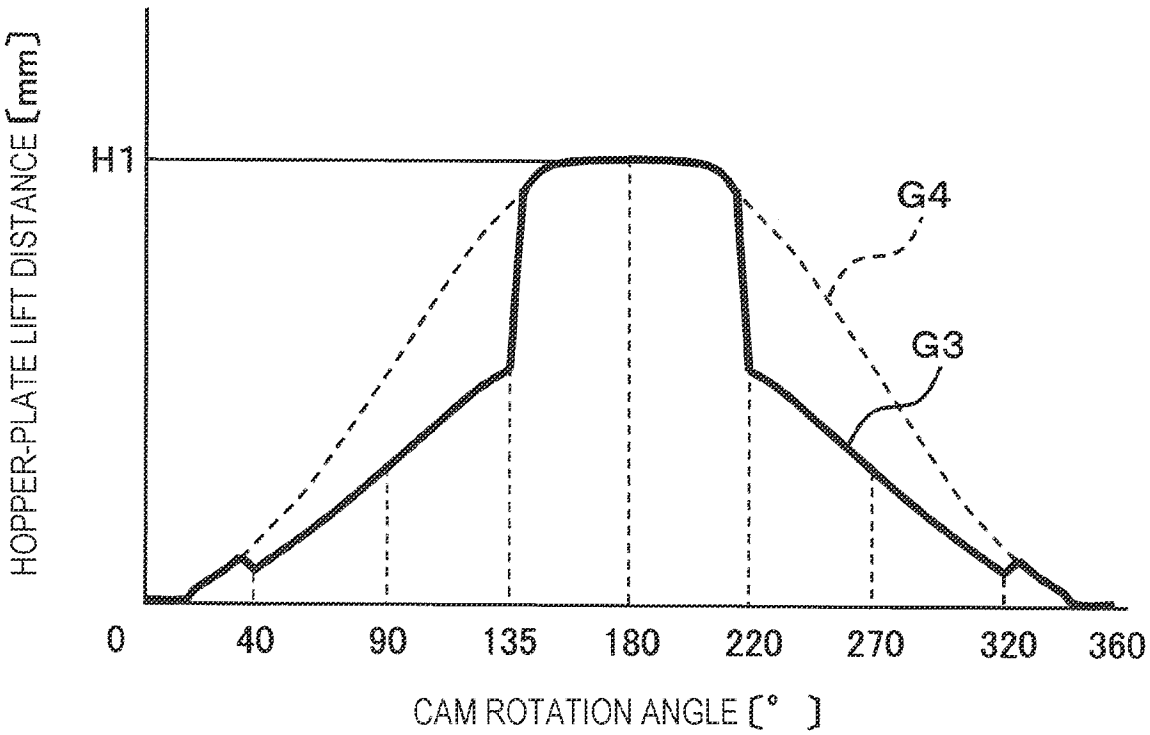
FIG. 13 is a graph illustrating the relationship between the cam rotation angle of the composite cam according to the embodiment and the lift distance of the lift plate.

FIG. 13 illustrates the relationship between the rotation angle and the lift distance of the hopper plate 62, in which the graph G3 of the solid line shows when using the drive transmission unit 70 of the present embodiment, and the graph G4 of the dashed line shows when using the drive transmission unit 200 of the comparative example. Note that in the ranges in which the lift distances of the graph G3 and the graph G4 are substantially the same, illustration of the graph G4 is omitted.

As the graph G4 shows, when using the drive transmission unit 200 of the comparative example, the lift distance continuously increases until it reaches H1 mm. In other words, there is a possibility that the hopper plate 62 may rise quickly. Note that in the range from the rotation angle 135° to the rotation angle 220°, the lift distance does not change because the hopper plate 62 is in contact with the feeding roller 66.

Next, operation of the printer 10, the feeding unit 50, and the drive transmission unit 70 will be described. For each configuration of the printer 10, refer to FIGS. 1 to 10 because description of the numbers of figures may be omitted in the following.

In the state in which the opening 12A is open, when the door portion 32 is moved from the open position to the close position, the projecting portion 76 is in contact with the large diameter portion 51B, and thereby the planetary gear 46 is pushed down in the −Z direction. When the projecting portion 76 moves over the large diameter portion 51B, the planetary gear 46 engages again with the transmission gear 73A. In this state, the driving force can be transmitted from the motor 42 to the rotation shaft 78 and the cam member 82.

After the motor 42 starts driving the rotation shaft 78 and the cam member 82 and while the cam member 82 is lowering the cam follower 104 and the hopper plate 62 in the −B direction, a positive torque for extending the extension spring 61 is generated in the cam member 82. Then, the cam member 82 passes the bottom dead center at which the rotation angle is 0°, and while the extension spring 61 is lifting up the hopper plate 62, a negative torque by the load of the contracting extension spring 61 is generated in the cam member 82. A larger negative torque means that the cam member 82 is likely to rotate on its axis.

FIG. 11A illustrates the cam member 82 positioned at the rotation angle 0° in the range R1. Part of the cam surface 89 is in contact with the contact surface 112C. The other cam surfaces are not in contact with the other contact surfaces. From this state, the cam member 82 starts to rotate in the counterclockwise direction. When the cam member 82 is within the range R1, the hopper plate 62 does not rise. From the time when the cam member 82 enters the range R2, the hopper plate 62 starts to rise.

Figure 11B:
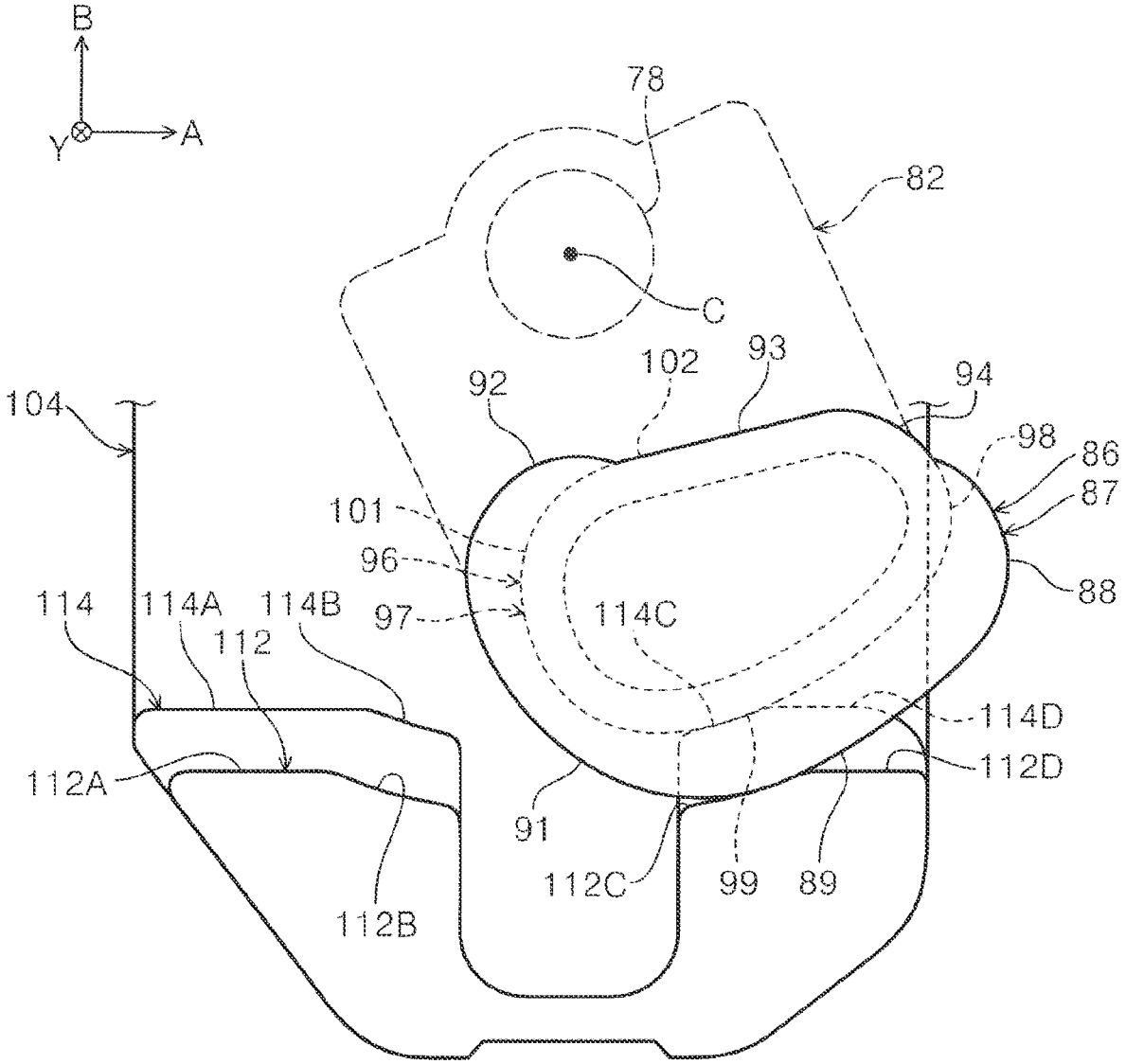
FIG. 11B is a front view of the composite cam according to the embodiment in the state in which only a first cam of the composite cam is in contact with the cam follower.

FIG. 11B illustrates the cam member 82 positioned at the rotation angle 40° in the range R3. Part of the cam surface 89 is in contact with the contact surface 112C only a little. At this time, part of the cam surface 99 starts to be in contact with the contact surface 114C. In other words, when the rotation angle exits the range R2 and enters the range R3, the portion of the cam member 82 that is in contact with the cam follower 104 is switched from the first cam 86 to the second cam 96.

Figure 11C:
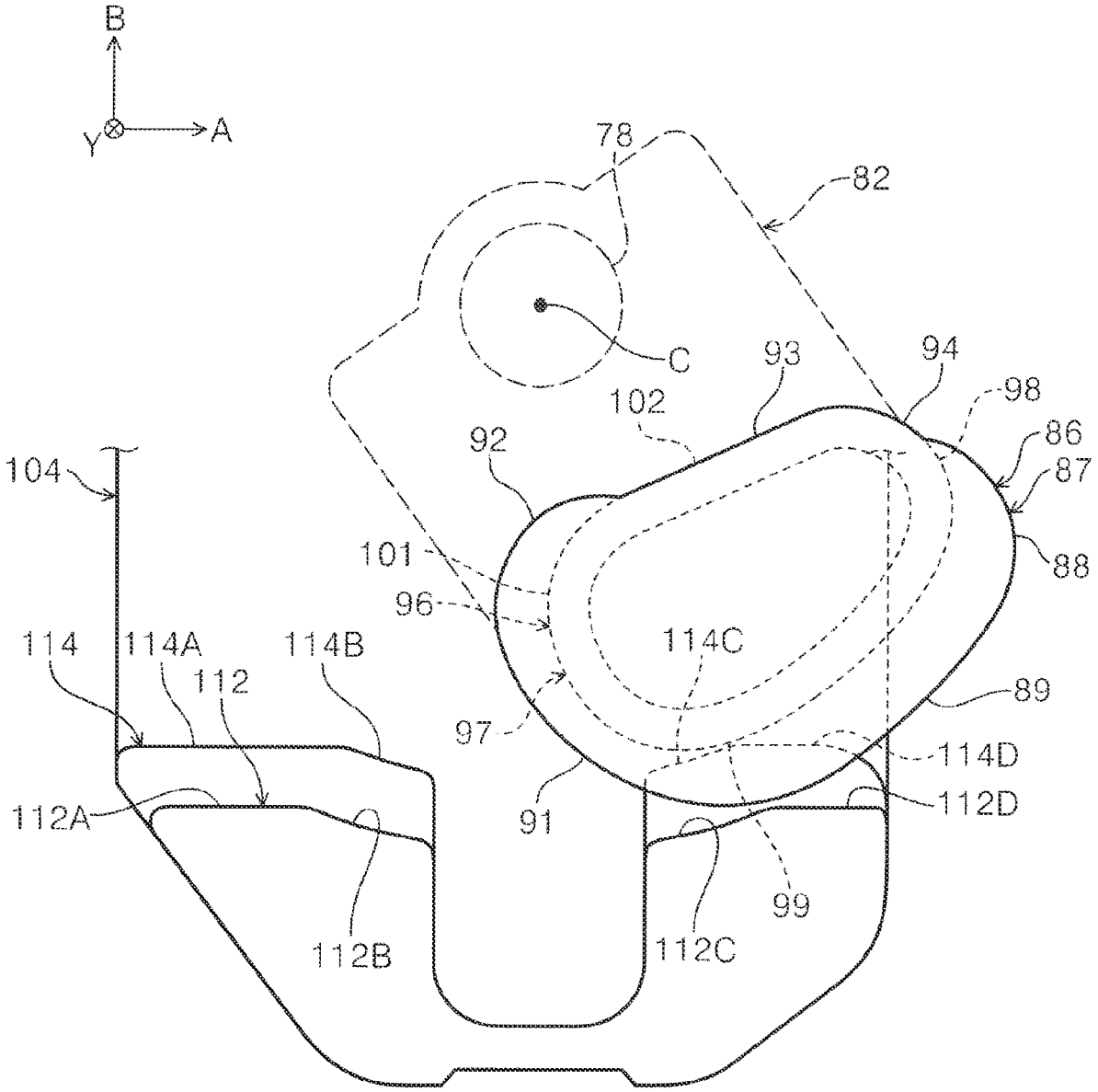
FIG. 11C is a front view of the composite cam according to the embodiment in the state in which the first cam moves apart from the cam follower, and a second cam of the composite cam starts to be in contact with the cam follower.

FIG. 11C illustrates the cam member 82 positioned at the rotation angle 41° in the range R3. The cam surface 89 is apart from the first contact portion 112. Part of the cam surface 99 is in contact with the contact surface 114C. In other words, the cam member 82 is in contact only with the second contact portion 114.

The position at which the part of the cam surface 99 is in contact with the contact surface 114C is in the −A direction relative to the position at which the cam surface 89 was in contact with the first contact portion 112 and is close to the rotation center C in the A direction. Thus, the torque acting on the cam member 82 when the cam member 82 is in contact with the second contact portion 114 becomes smaller than when the cam member 82 was in contact with the first contact portion 112.

Figure 11D:
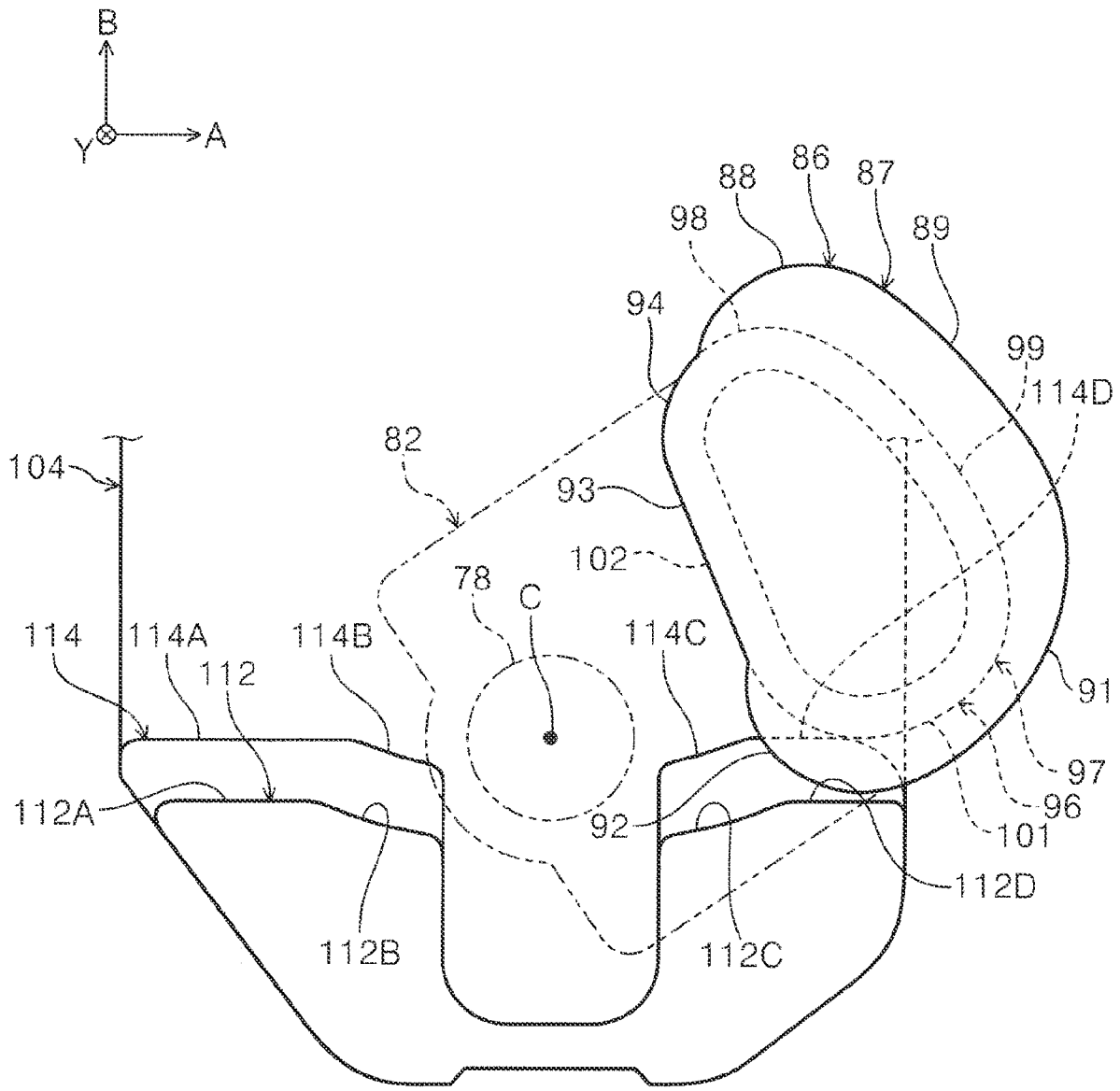
FIG. 11D is a front view of the composite cam according to the embodiment in the state in which only the second cam is in contact with the cam follower.

FIG. 11D illustrates the cam member 82 positioned at the rotation angle 130° in the range R3. The part of the cam surface 99 is apart from the contact surface 114C, and part of the cam surface 101 is in contact with the contact surface 114D.

Although illustration is omitted, by the time when the rotation angle of the cam member 82 advances from the rotation angle 135° to the rotation angle 136° in the range R4, the contact point is switched from the second cam 96 to the first cam 86. For the rotation angle 136° or more in the range R4, only the first cam 86 is in contact with the cam member 82.

Figure 11E:
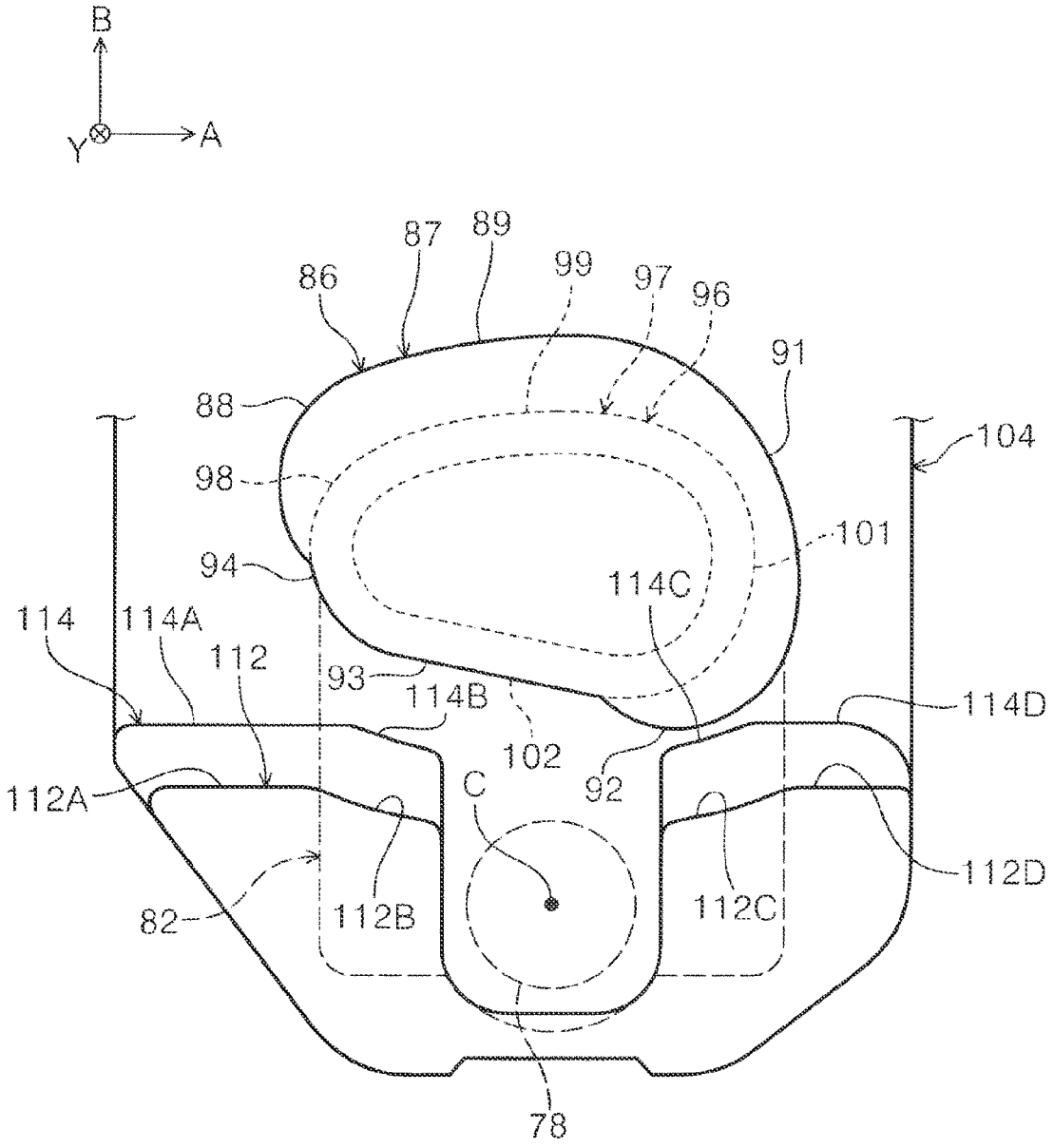
FIG. 11E is a front view of the composite cam according to the embodiment in the state in which the first cam and the second cam are apart from the cam follower.

FIG. 11E illustrates the cam member 82 positioned at the rotation angle 179° in the range R5. In the range R5, since the hopper plate 62 is in contact with the feeding roller 66, the rising movement of the cam follower 104 is restricted. In this state, since the cam member 82 continues to rotate, the first cam 86 and the second cam 96 move apart in the +B direction from the first contact portion 112 and the second contact portion 114.

Although illustration is omitted, when the cam member 82 is positioned in the range R6, the first cam 86 and the second cam 96 are apart in the +B direction from the first contact portion 112 and the second contact portion 114.

When the cam member 82 is positioned in the range R7, the first cam 86 is in contact with the first contact portion 112, and thereby the hopper plate 62 starts to move down and away from the feeding roller 66. At this time, the second cam 96 is not in contact with the second contact portion 114.

Figure 11F:
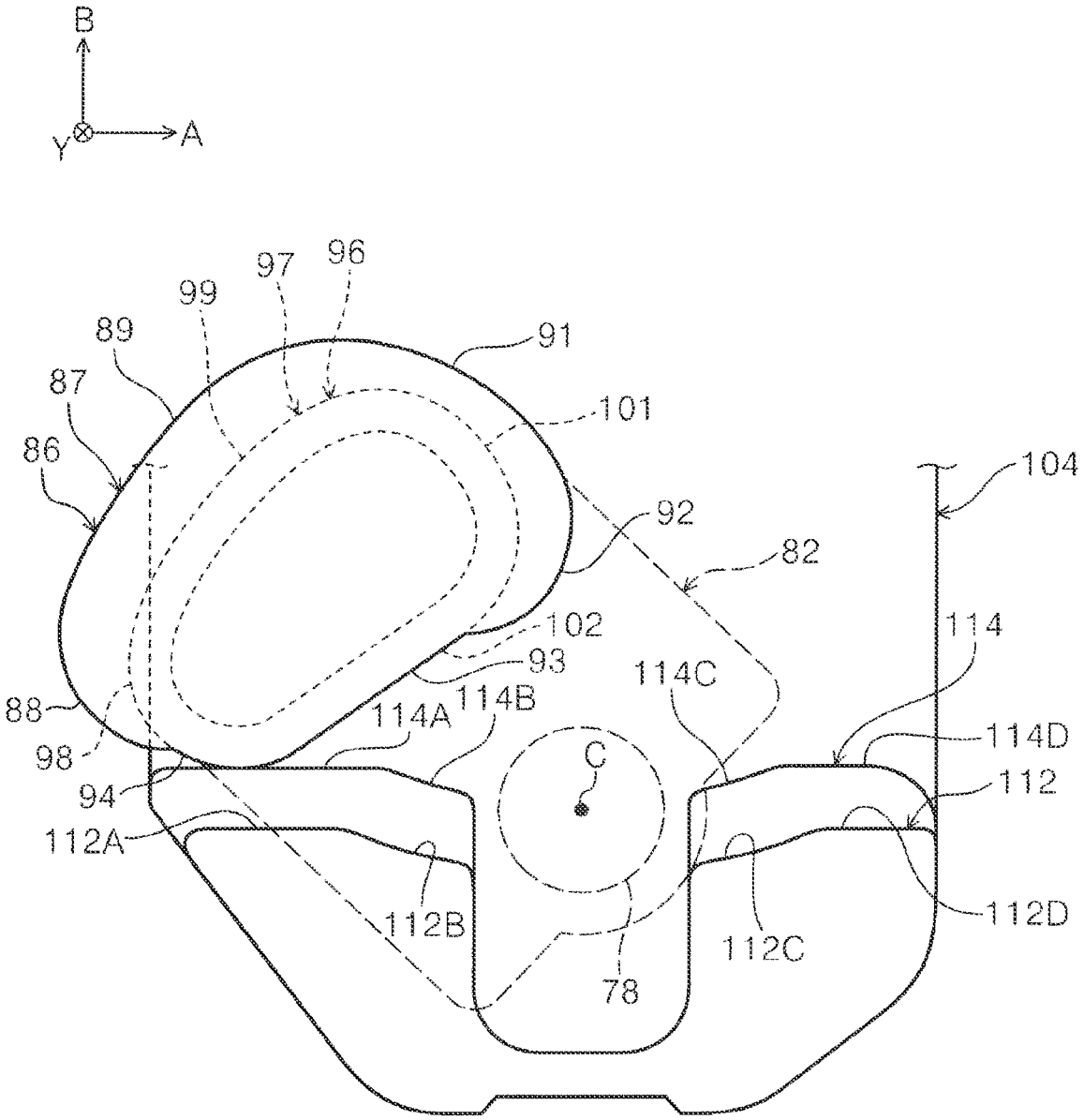
FIG. 11F is a front view of the composite cam according to the embodiment in the state in which only the second cam starts to be in contact with the cam follower.

FIG. 11F illustrates the cam member 82 positioned at the rotation angle 225° in the range R8. In the range R8, the portion of the cam member 82 that is in contact with the cam follower 104 is switched from the first cam 86 to the second cam 96. The contact position of the cam surface 98 moves from the contact surface 114A to the contact surface 114B.

Figure 11G:
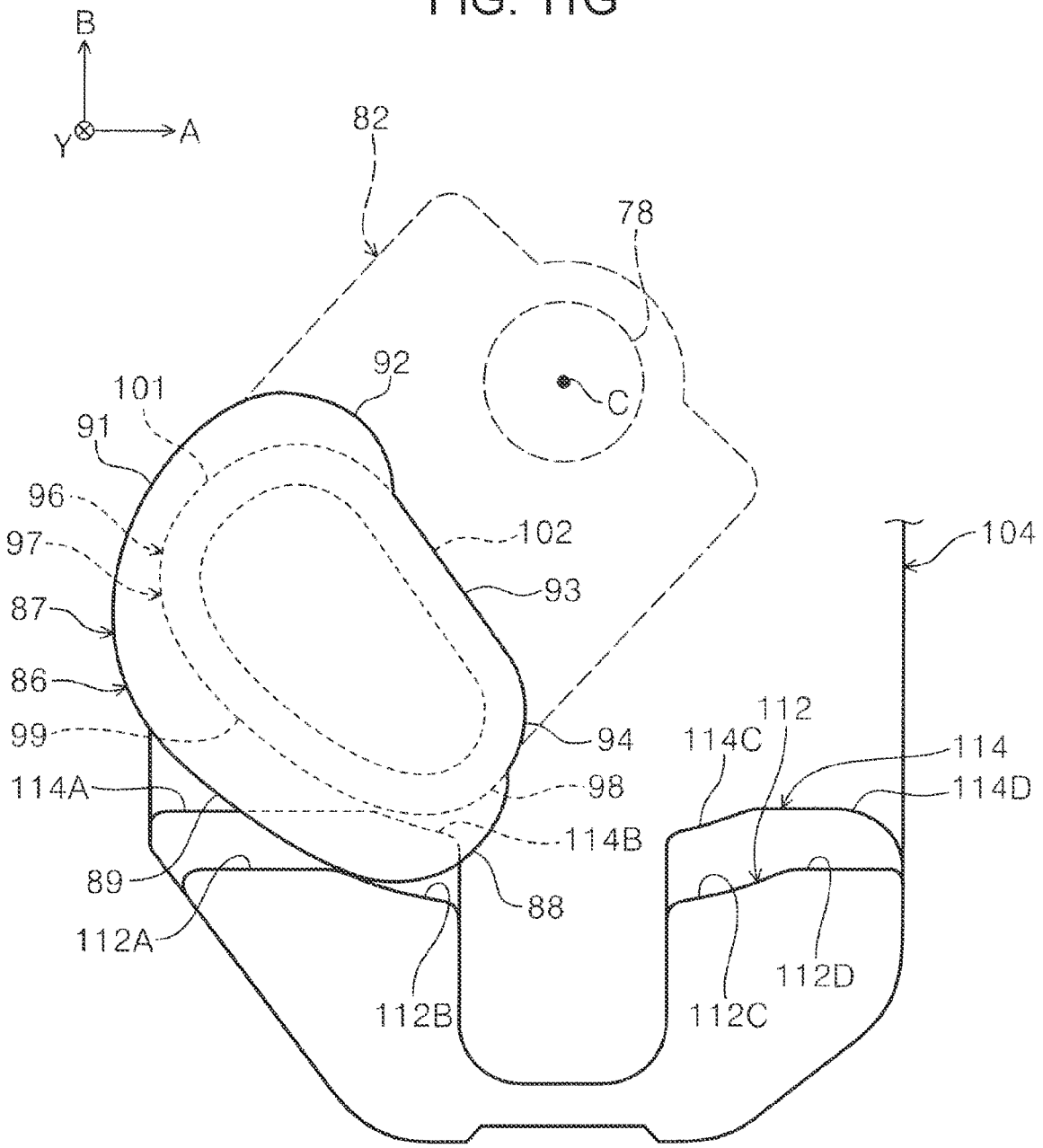
FIG. 11G is a front view of the composite cam according to the embodiment in the state in which the second cam moves apart from the cam follower and the first cam starts to be in contact with the cam follower.

FIG. 11G illustrates the cam member 82 positioned at the rotation angle 321° in the range R9. In the range R9, the portion of the cam member 82 that is in contact with the cam follower 104 is switched from the second cam 96 to the first cam 86. In the ranges R9 and R10, only the first cam 86 is in contact with the cam follower 104.

Although illustration is omitted, when the cam member 82 is positioned at the rotation angle 330° in the range R10, the descending movement of the hopper plate 62 stops. After that, while the cam member 82 is changing the rotation angle in the range R10, the hopper plate 62 does not move.

The range R1 and the range R10 are a bottom dead center range in which the hopper plate 62 is held at the lowest point. The range R5 and the range R6 are a top dead center range in which the hopper plate 62 is held at the highest point.

The ranges R1, R5, R6, and R10 are stable ranges in which the cam follower 104 is not moved by the rotation of the cam member 82.

The ranges R2, R3, R4, R7, R8, and R9 are movement ranges in which the cam follower 104 is moved by the rotation of the cam member 82.

Figure 14:
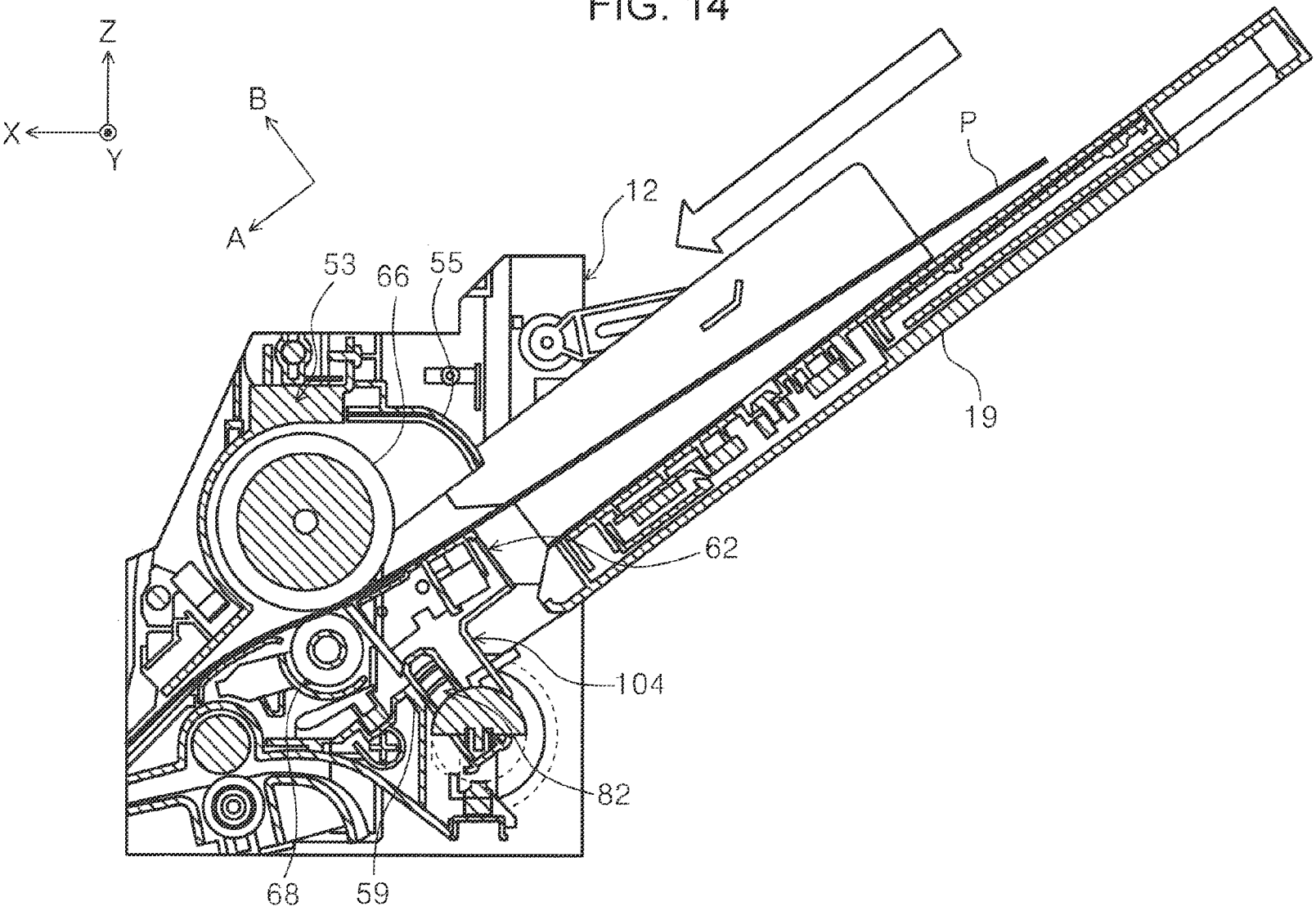
FIG. 14 is a longitudinal sectional view of the feeding unit according to the embodiment with the lift plate lifted up.

As illustrated in FIG. 14, when the cam member 82 is positioned in the top dead center range, the hopper plate 62 is positioned at the highest point in the +B direction. In this state, the leading end portion of a sheet P on the manual tray 19 is in contact with the feeding roller 66, and feeding is ready.

As graphs G1 and G2 in FIG. 12 indicate, since in the drive transmission unit 70, the portion of the cam member 82 that is in contact with the cam follower 104 is switched from the first cam 86 to the second cam 96, the torque acting on the cam member 82 is smaller than that of the above-described comparative example. Thus, the torque acting on the cam member 82 can be restricted within the range from the allowable torque −T to the allowable torque +T.

As the graphs G3 and G4 in FIG. 13 indicate, in the drive transmission unit 70, although the contact point is switched from the first cam 86 to the second cam 96, the maximum lift distance of the hopper plate 62 is substantially the same as the comparative example.

As has been described above, in the drive transmission unit 70, when the motor 42 rotates the cam member 82, the first cam 86 moves the cam follower 104 in the −B direction, and thereby the cam follower 104 moves to the position farthest from the rotation shaft 78. When the cam follower 104 is moved by the rotation of the cam member 82 in the −B direction, this operation includes contact between the outer peripheral surface 97 of the second cam 96 and the cam follower 104. With this configuration, the contact counterpart of the cam follower 104 can be switched from the first cam 86 to the second cam 96.

Here, the pressing force caused by the extension spring 61 and acting on the contact position between the outer peripheral surface 87 and the cam follower 104 and the pressing force caused by the extension spring 61 and acting on the contact position between the outer peripheral surface 97 and the cam follower 104 are substantially equal. Since the outer peripheral surface 97 is positioned closer to the rotation shaft 78 than the outer peripheral surface 87, the distance from the center of the rotation shaft 78 to the contact position between the outer peripheral surface 97 and the cam follower 104 is shorter than the distance from the center of the rotation shaft 78 to the contact position between the outer peripheral surface 87 and the cam follower 104.

In other words, the torque acting on the cam member 82 and the rotation shaft 78 is smaller when the outer peripheral surface 97 is in contact with the cam follower 104 than when the outer peripheral surface 87 is in contact with the cam follower 104. Thus, when the rotation shaft 78 rotates, and the cam follower 104 is moved in the −B direction, the torque acting on the cam member 82 and the motor 42 can be small.

In the drive transmission unit 70, since the torque acting on the rotation shaft 78 and the drive gear train 43 can be small when the outer peripheral surface 97 is in contact with the cam follower 104, the holder 48 is prevented from being shaken when the torque acts in the direction to move the planetary gear 46 from the first position to the second position, and this can reduce occurrence of tooth skipping between the planetary gear 46 and the drive gear train 43.

In the drive transmission unit 70, when the state transitions from the one in which the outer peripheral surface 87 is in contact with the first contact portion 112 to the one in which the outer peripheral surface 97 is in contact with the second contact portion 114, there is a moment when the outer peripheral surface 87 is in contact with the first contact portion 112, and also the outer peripheral surface 97 is in contact with the second contact portion 114. With this configuration, immediately before the outer peripheral surface 97 starts to be in contact with the second contact portion 114, there is no moment when the cam follower 104 is in contact with neither the outer peripheral surface 87 nor the outer peripheral surface 97. This configuration reduces fluctuation of the torque acting on the motor via the rotation shaft 78 at the time when the contact counterpart of the cam follower 104 is switched from the first cam 86 to the second cam 96.

In the drive transmission unit 70, during one rotation of the rotation shaft 78, the contact counterpart of the cam follower 104 changes from the outer peripheral surface 87 via the outer peripheral surface 97 to the outer peripheral surface 87. In this configuration, as compared with the configuration in which the contact counterpart of the cam follower 104 changes from the outer peripheral surface 87 only to the outer peripheral surface 97 during one rotation of the rotation shaft 78, the time during which the cam follower 104 is in contact with the outer peripheral surface 97 is short. Thus, it is possible to reduce the sliding wear of the outer peripheral surface 97.

In the drive transmission unit 70, since the dimensional error of the second cam 96 relative to the first cam 86 that occurs in assembling can be eliminated, the positional accuracy of the second cam 96 relative to the first cam 86 can be high, compared to the configuration in which the first cam 86 and the second cam 96 are separate portions.

In the drive transmission unit 70, when the cam follower 104 is moved by the rotation of the cam member 82 in the +B direction, this operation includes contact between the outer peripheral surface 97 and the cam follower 104. With this configuration, the contact counterpart of the cam follower 104 can be switched from the first cam 86 to the second cam 96.

Here, as mentioned above, the pressing force caused by the extension spring 61 and acting on the contact position between the outer peripheral surface 87 and the cam follower 104 and the pressing force caused by the extension spring 61 and acting on the contact position between the outer peripheral surface 97 and the cam follower 104 are substantially equal. Since the outer peripheral surface 97 is positioned closer to the rotation shaft 78 than the outer peripheral surface 87, the distance from the center of the rotation shaft 78 to the contact position between the outer peripheral surface 97 and the cam follower 104 is shorter than the distance from the center of the rotation shaft 78 to the contact position between the outer peripheral surface 87 and the cam follower 104.

In other words, the torque acting on the cam member 82 is smaller when the outer peripheral surface 97 is in contact with the cam follower 104 than when the outer peripheral surface 87 is in contact with the cam follower 104. Thus, when the rotation shaft 78 rotates, and the cam follower 104 is moved in the +B direction, the torque acting on the cam member 82 can be small, and the rotation of the cam member 82 on its axis can be reduced.

The feeding unit 50 provides operations and effects the same as or similar to those provided by the drive transmission unit 70.

The printer 10 provides operations and effects the same as or similar to those provided by the feeding unit 50.

The embodiment of the present disclosure is based on the configuration as has been described above, but it is possible, as a matter of course, to make change, elimination, or the like in part of the configuration within the scope not departing from the spirit of the disclosure of the present application.

Modification

The second friction coefficient of the surface of contact between the outer peripheral surface 97 and the second contact portion 114 may be set higher than the first friction coefficient of the surface of contact between the outer peripheral surface 87 and the first contact portion 112. Note that the area in which the second friction coefficient is set higher than the first friction coefficient may be only part of the outer peripheral surface 97 that the cam follower 104 is in contact when the cam follower 104 rises, in other words, when the cam follower 104 moves in the first direction. It is because when the second friction coefficient is set higher in another part of the outer peripheral surface 97 that the cam follower 104 is in contact with when the cam follower 104 moves down, in other words, when the cam follower 104 moves in the second direction, an extra load may act on the rotation of the cam member 82.

In the drive transmission unit 70 of the modification, when the state transitions from the one in which the outer peripheral surface 87 is in contact with the cam follower 104 to the one in which the outer peripheral surface 97 is in contact with the cam follower 104, the second friction coefficient higher than the first friction coefficient generates the counter torque acting on the outer peripheral surface 97 which is in contact with the cam follower 104. This configuration reduces a rapid increase in the rotation speed of the second cam 96 when the outer peripheral surface 97 comes into contact with the cam follower 104.

As an example of a method to obtain the second friction coefficient, the outer peripheral surface 97 may be processed such that its surface roughness is higher than that of the outer peripheral surface 87.

The drive transmission unit 70 does not necessarily include the planetary gear 46 and the holder 48. The drive transmission unit 70 is not necessarily provided at a portion where the door portion 32 is opened and closed. In the drive transmission unit 70, the first cam 86 and the second cam 96 may be separate portions, and each of them may be attached to the rotation shaft 78. The second friction coefficient may be equal to the first friction coefficient. The method of making the second friction coefficient higher than the first friction coefficient is not limited to the method of increasing the surface roughness, but it may be a method in which the outer peripheral surface 97 is formed of a member different from that of the outer peripheral surface 87.

The numerical values of the rotation angles are mere examples, and hence, the rotation angles may be set to other numerical values. The ten ranges from the ranges R1 to R10 in one rotation of the cam member 82 are illustrated as mere examples. Hence, the way of dividing one rotation into sectors may be changed, and the number of ranges may be smaller than or larger than ten. The number of the cam surfaces of each of the first cam 86 and the second cam 96 may be a number different from the number in the above embodiment.

The configuration of the cam member 82 is not limited to the one having two tiers using the first cam 86 and the second cam 96, but it may have three or more tiers. With this configuration, the graph G3 can be a gentler curved line, and the acting torque can also be reduced.

Figure 16:
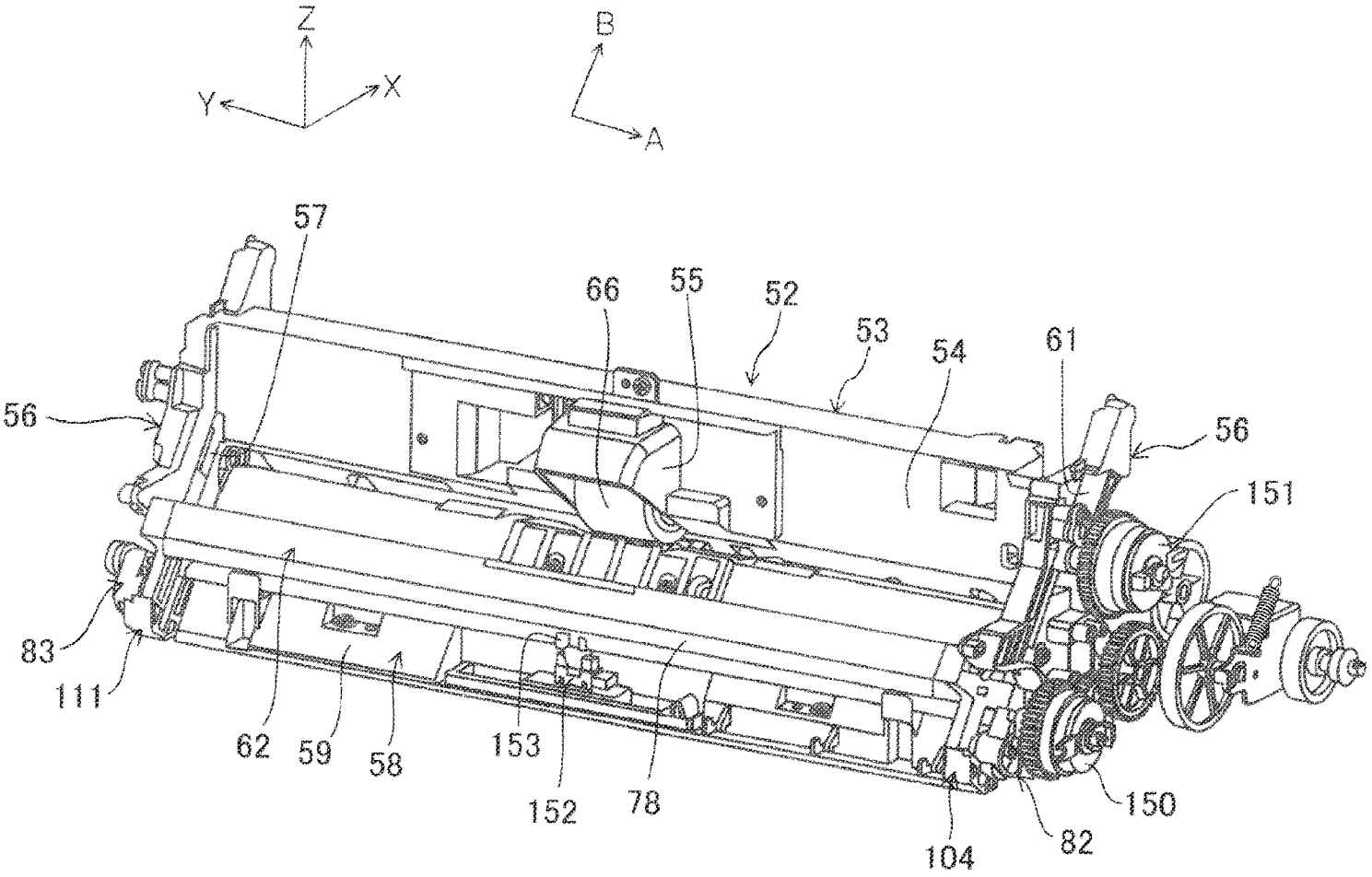
FIG. 16 is a perspective view of part of a feeding unit according to an embodiment different from the feeding unit in FIG. 4.

Hereinafter, with reference to FIGS. 16 to 20, still another modification will be described. A printer 10 of the modification has a configuration in which the rotation of a cam member 82 and a cam member 83 that rotate about a rotation shaft 78 can be stopped, instead of by stopping a motor 42, by turning off an electromagnetic clutch 150 coupled to the motor 42. As illustrated in FIG. 16, the printer 10 of the modification includes the electromagnetic clutch 150 of the rotation shaft 78 which is a cam drive shaft and also includes an electromagnetic clutch 151 of the rotation shaft of the feeding roller 66. In the configuration in which the cam portion can be stopped not by stopping the motor but by turning off the electromagnetic clutch, as in the printer 10 of the modification as illustrated in FIGS. 16 to 20, it is sometimes difficult to stop the cam portion at a desired position due to the inertia of the cam portion, gears, and the like along with the rotation of the cam portion. To address such a problem, the printer 10 of the modification illustrated in FIGS. 16 to 20 has a configuration in which the cam portion can be stopped at a desired position.

Figure 17:
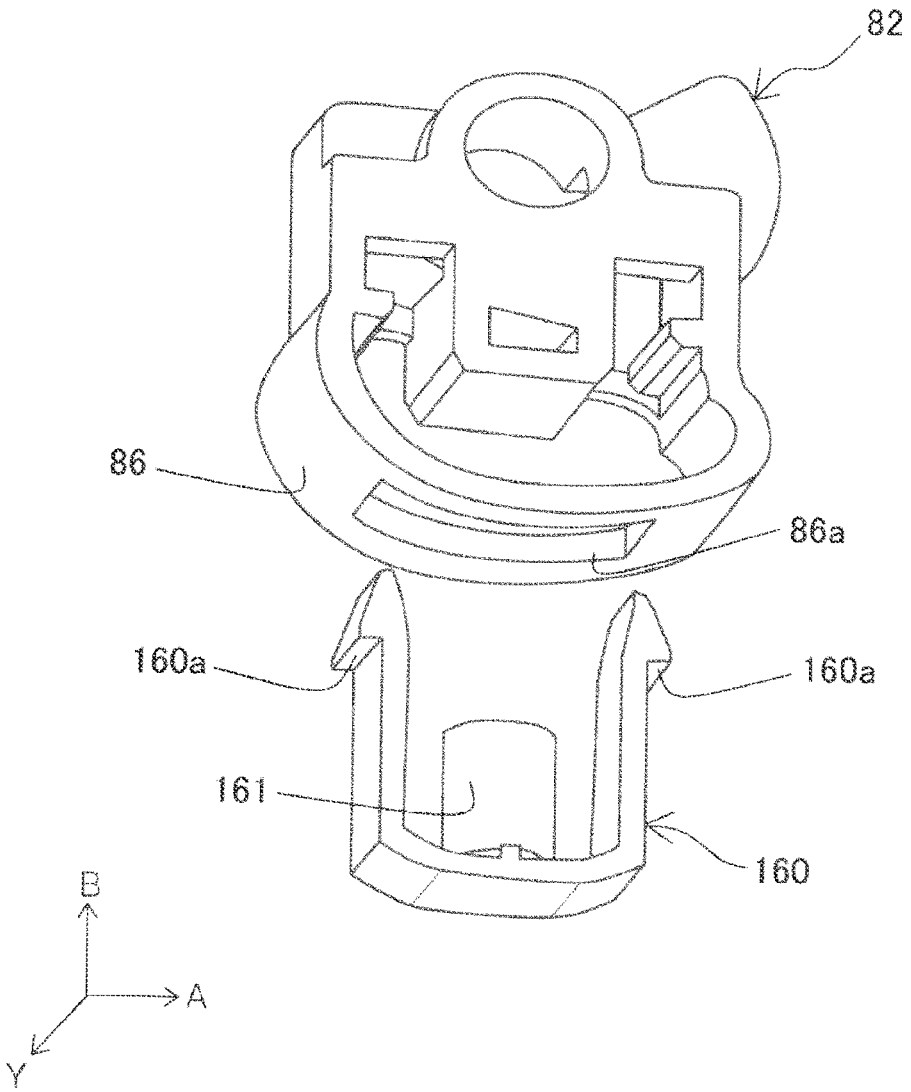
FIG. 17 is a perspective view of a cam portion and a brake member of the feeding unit in FIG. 16.

Here, in the printer 10 of the modification illustrated in FIGS. 16 to 20, the cam member 82 and its peripheries has a configuration the same as or similar to that of the cam member 83 and its peripheries. Hence, the following description can also be applied to the configuration of the cam member 83 and its periphery. As illustrated in FIG. 17, the cam member 82 is provided with a brake member 160 that can impede the rotation of the cam member 82. A compression spring 161 is engaged with the brake member 160, and the brake member 160 is inserted into a hole 86*a* formed in the first cam 86. Thus, the brake member 160 protrudes from the inside of the cam member 82 to the outside. The compression spring 161 is positioned between the brake member 160 and the cam member 82, and it urges the brake member 160 in a direction away from the cam member 82. The brake member 160 has two protrusions 160*a*, which are caught at the hole 86*a*, and thus not the entirety of the brake member 160 projects out of the hole 86*a* to the outside.

Figure 18:
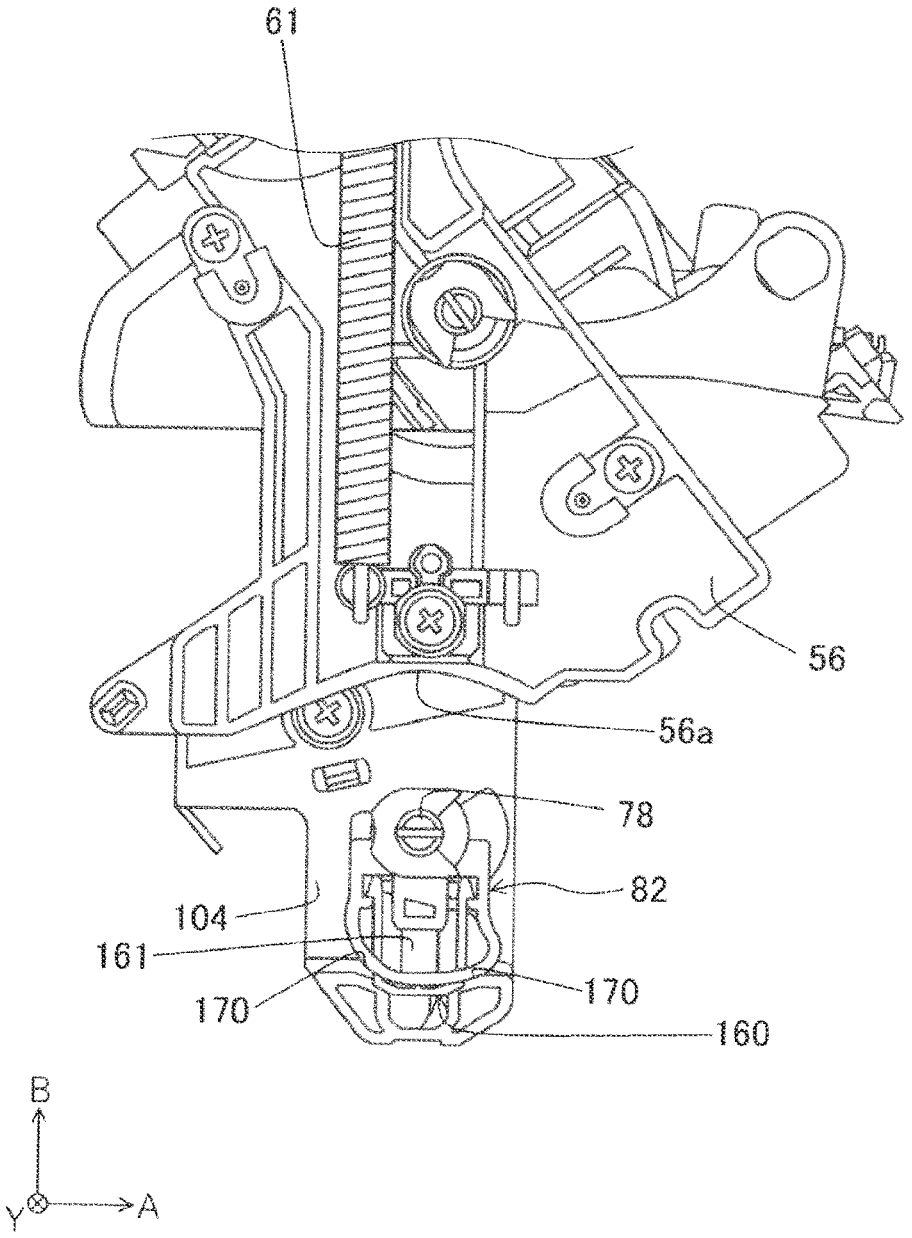
FIG. 18 is a front view of the cam portion, the cam follower, and their peripheries of the feeding unit in FIG. 16 in the state in which the cam portion is in contact with the cam follower.
Figure 19:
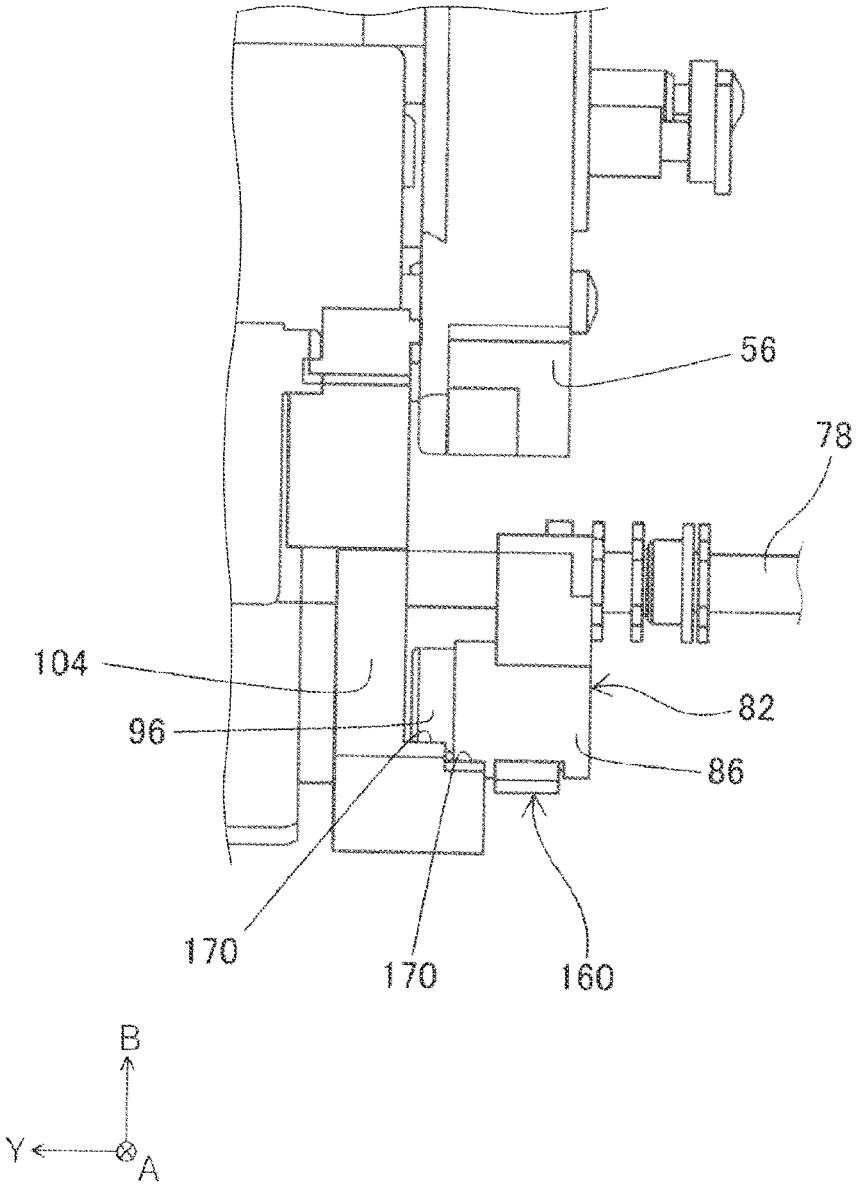
FIG. 19 is a side view of the cam portion, the cam follower, and their peripheries of the feeding unit in FIG. 16 in the state in which the cam portion is in contact with the cam follower.
Figure 20:
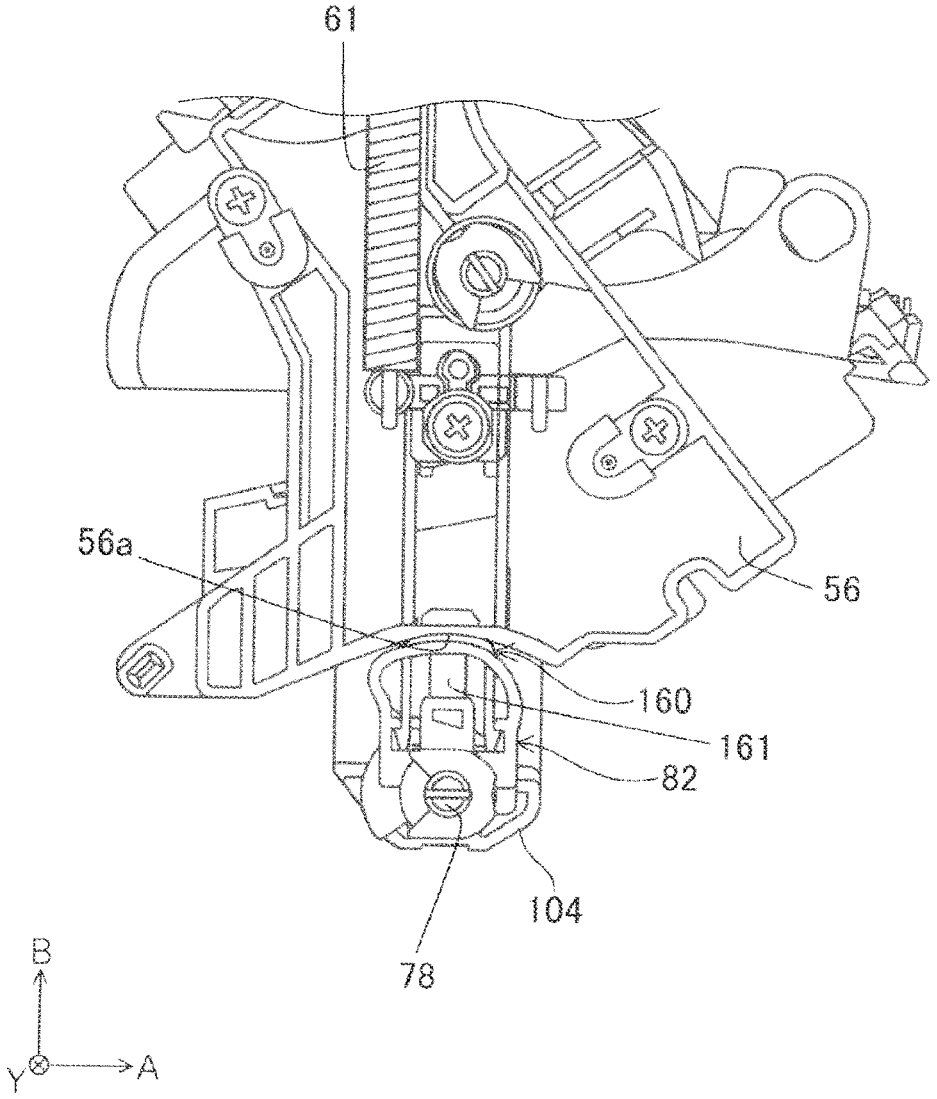
FIG. 20 is a front view of the cam portion, the cam follower, and their peripheries of the feeding unit in FIG. 16 in the state in which the cam portion is not in contact with the cam follower.

The cam member 82 can move, by rotating about the rotation shaft 78, to the first position at which at least one of the first cam 86 and the second cam 96 is in contact with the cam follower 104 as illustrated in FIGS. 18 and 19 and the second position at which neither the first cam 86 nor the second cam 96 is in contact with the cam follower 104 as illustrated in FIG. 20. The brake member 160 is in contact with a side frame 56 at the second position illustrated in FIG. 20 to impede the rotation of the cam member 82. Although in this example, the first position is a bottom dead center range, and the second position is a top dead center range, the first position may be a position different from the bottom dead center range, and the second position may be a position different from the top dead center range.

As in the printer 10 of the modification, in a configuration in which the cam portion can move to a position at which the cam portion is in contact with the cam follower and a position at which it is not, it is difficult in some cases to stop the cam portion at the optimum position at the position at which the cam portion is not in contact with the cam follower. However, in the printer 10 of the modification, the cam member 82 includes the brake member 160, and the brake member 160 impedes the rotation of the cam member 82 at the second position at which the cam member 82 is not in contact with the cam follower 104. With this configuration in the printer 10 of the modification, even in the state in which the cam member 82 is not in contact with the cam follower 104, it is possible to stop the cam member 82 at the optimum position.

In a description from a different viewpoint, when the cam member 82 is at the first position as illustrated in FIGS. 18 and 19, the inertia of the cam member 82, gears, and the like is canceled by the friction force acting on the contact point 170 between the cam member 82 and the cam follower 104, and thus, it is possible to stop the cam member 82 at the first position, which is the desired position, when the electromagnetic clutch 150 is turned off. When the cam member 82 is at the second position as illustrated in FIG. 20, the friction force generated by the contact between the brake member 160 and the contacted portion 56*a* of the side frame 56 is canceled by the inertia of the cam portions, gears, and the like. Thus, when the electromagnetic clutch 150 is turned off, it is possible to stop the cam member 82 at the second position which is the desired position. Here, in a configuration in which the brake member 160 is not provided to the cam member 82, there are cases in which it is difficult to stop the cam member 82 at the second position.

Specifically, the printer 10 of the modification illustrated in FIGS. 16 to 20 includes, in the side frame 56, the contacted portion 56*a* configured to be in contact with the brake member 160, and also includes the compression spring 161 as an urging portion that urges the brake member 160 in the projecting direction in which the brake member 160 projects from the first cam 86. Here, when the brake member 160 is pressed from the outside of the cam member 82 to the inside, the brake member 160 retracts, and when it is not pressed, the brake member 160 projects from the hole 86*a* by the urging force of the compression spring 161. In other words, it can be expressed that the brake member 160 can move to a projecting position at which the brake member 160 projects from the first cam 86 by being urged by the compression spring 161 and a retreat position to which the brake member 160 moves from the projecting position in a direction opposite from the projecting direction and which is positioned in a direction opposite from the projected position. The brake member 160 is in contact with the contacted portion 56*a* at the second position, where the brake member 160 can move from the projecting position to the retreat position by being pressed by the contacted portion 56*a* from the outside to the inside against the urging force of the compression spring 161. As above, the brake member 160 moves to the retreat position against the urging force of the compression spring 161, and this generates the friction force between the brake member 160 and the contacted portion 56*a*, and the friction force serves as a resistance to the rotation of the cam member 82. The resistance impedes the rotation of the cam member 82, and thereby the cam member 82 can stop at the second position. Since the brake member 160 can move to the projecting position and the retreat position as above, the brake member 160 can be positioned inside the cam member 82, and thus, the printer 10 is reduced in size. In addition, since the brake member 160 can move to the retreat position, when the cam member 82 is in contact with the contacted portion 56*a*, it is possible to avoid the state in which the cam member 82 cannot move from the contacted portion 56*a*.

As illustrated in FIG. 16, the printer 10 of the modification has a sensor 152 and a sensor flag 153, with which it is possible to detect the rotation phase of the rotation shaft 78. The sensor flag 153 is provided on the rotation shaft 78, and when the sensor 152 detects an end portion of the sensor flag 153 and after a desired time passes, the electromagnetic clutch 150 can be turned off. As above, in the printer 10 of the modification, it is possible to stop the cam member 82 at a desired position. However, without the configuration to make it possible to stop the cam portion at a desired position, the stop position of the cam portion may be shifted from a desired position, and for example, the feeding roller may be released while it is pressing a medium to feed it, or other failures may occur. This would cause a medium transportation failure or the like.

What is claimed is:

1. A drive transmission device comprising:

a cam portion configured to rotate about a rotation shaft;

a drive source configured to drive the rotation shaft to rotate the cam portion;

a cam follower configured to be in contact with the cam portion and move, by rotation of the cam portion, in a first direction to be close to the rotation shaft and in a second direction to be away from the rotation shaft; and an extension spring configured to press the cam follower against the cam portion, wherein the cam portion includes a first cam defining a maximum distance between the cam follower and the rotation shaft and a second cam having an inner edge portion positioned closer to the rotation shaft than an outer edge portion of the first cam, and in a process of the cam follower moving in the second direction by the rotation of the cam portion, a portion of the cam portion, the portion being in contact with the cam follower, is switched from the second cam to the first cam, wherein, a second friction coefficient, which is a coefficient of friction between the inner edge portion and the cam follower, is higher than a first friction coefficient, which is a coefficient of friction between the outer edge portion and the cam follower.

2. The drive transmission device according to claim 1, further comprising:

a drive gear train configured to transmit a driving force from the drive source to the rotation shaft;

a planetary gear configured to engage with part of the drive gear train; and a holder configured to hold the planetary gear such that the planetary gear is configured to swing between a first position at which the planetary gear engages with the part of the drive gear train and a second position at which the planetary gear does not engage with the part of the drive gear train, wherein torque acting on the rotation shaft when the inner edge portion is in contact with the cam follower acts in a direction to move the planetary gear from the first position to the second position.

3. The drive transmission device according to claim 1, wherein the cam follower has a first contact portion configured to be in contact with the outer edge portion and a second contact portion configured to be in contact with the inner edge portion, and when the rotation shaft is rotated in a state in which the outer edge portion is in contact with the first contact portion, contact between the inner edge portion and the second contact portion starts before the outer edge portion is apart from the first contact portion.

4. The drive transmission device according to claim 1, wherein in one rotation of the rotation shaft, before the inner edge portion is apart from the cam follower, contact between the outer edge portion and the cam follower starts.

5. The drive transmission device according to claim 1, wherein the first cam and the second cam are integrally formed.

6. The drive transmission device according to claim 1, wherein in a process of the cam follower moving in the first direction, a portion of the cam portion, the portion being in contact with the cam follower, is switched from the first cam to the second cam.

7. The drive transmission device according to claim 1, wherein the cam portion is provided with a brake member configured to impede the rotation of the cam portion, the cam portion is configured to move, by rotating about the rotation shaft, to a first position at which at least one of the first cam and the second cam is in contact with the cam follower and to a second position at which neither the first cam nor the second cam is in contact with the cam follower, and the brake member impedes the rotation of the cam portion at the second position.

8. The drive transmission device according to claim 7, further comprising:

a contacted portion configured to be in contact with the brake member; and compression spring configured to urge the brake member in a projecting direction in which the brake member projects from the first cam, wherein the brake member is configured to move to a projecting position at which the brake member projects from the first cam by being urged by the compression spring and to a retreat position, to which the brake member moves from the projecting position in a direction opposite from the projecting direction, positioned in a direction opposite from the projecting position, and when the brake member is in contact with the contacted portion at the second position, moves from the projecting position to the retreat position against an urging force of the compression spring.

9. A feeding device comprising:

the drive transmission device according to claim 1;

a hopper plate configured to be lifted up and down, along with movement of the cam follower, from one of a feeding position at which a medium is ready to be fed and a retreat position away from the feeding position, to the other of the feeding position and the retreat position; and a feeding roller configured to rotate and feed a medium on the hopper plate when the hopper plate is at the feeding position.

10. A printing apparatus comprising:

the feeding device according to claim 9; and a printing unit configured to perform printing on a medium fed from the feeding device.

11. A drive transmission device comprising:

a cam portion configured to rotate about a rotation shaft;

a drive source configured to drive the rotation shaft to rotate the cam portion;

a drive gear train configured to transmit a driving force from the drive source to the rotation shaft;

a planetary gear configured to engage with part of the drive gear train;

a holder configured to hold the planetary gear such that the planetary gear is configured to swing between a first position at which the planetary gear engages with the part of the drive gear train and a second position at which the planetary gear does not engage with the part of the drive gear train;

a cam follower configured to be in contact with the cam portion and move, by rotation of the cam portion, in a first direction to be close to the rotation shaft and in a second direction to be away from the rotation shaft; and an extension spring configured to press the cam follower against the cam portion, wherein the cam portion includes a first cam defining a maximum distance between the cam follower and the rotation shaft and a second cam having an inner edge portion positioned closer to the rotation shaft than an outer edge portion of the first cam, in a process of the cam follower moving in the second direction by the rotation of the cam portion, a portion of the cam portion, the portion being in contact with the cam follower, is switched from the second cam to the first cam, and torque acting on the rotation shaft when the inner edge portion is in contact with the cam follower acts in a direction to move the planetary gear from the first position to the second position.

* * * * *